US006321542B1

(12) United States Patent
Ueno et al.

(10) Patent No.: US 6,321,542 B1
(45) Date of Patent: Nov. 27, 2001

(54) METHOD FOR CLEANING PIPE AND PIPE CLEANING APPARATUS FOR REFRIGERATING APPARATUS

(75) Inventors: Takeo Ueno; Toshihiro Iijima; Masaaki Takegami; Masaki Yamamoto, all of Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/402,126

(22) PCT Filed: Mar. 25, 1998

(86) PCT No.: PCT/JP98/01354

§ 371 Date: Sep. 30, 1999

§ 102(e) Date: Sep. 30, 1999

(87) PCT Pub. No.: WO98/44304

PCT Pub. Date: Aug. 10, 1998

(30) Foreign Application Priority Data

Apr. 2, 1997 (JP) ..... 9-083572
Oct. 28, 1997 (JP) ..... 9-295641

(51) Int. Cl.[7] ..... F25B 45/00; F25B 43/04

(52) U.S. Cl. ..... 62/77; 62/149; 62/474; 62/475

(58) Field of Search ..... 62/77, 149, 292, 62/474, 475, 85, 195, 470

(56) References Cited

U.S. PATENT DOCUMENTS 4,476,688 * 10/1984 Goddard ..... 62/149
4,862,699 9/1989 Lounis .
4,982,576 1/1991 Proctor et al. .
5,012,651 * 5/1991 Nakatani et al. ..... 62/149
5,036,675 8/1991 Anderson, Jr. .

(List continued on next page.)

FOREIGN PATENT DOCUMENTS 61 070388 4/1986 (JP) .
62-26491 2/1987 (JP) .
6-207765 7/1994 (JP) .
07 000937 1/1995 (JP) .
7-83545 3/1995 (JP) .
7-270000 10/1995 (JP) .
2593403 12/1996 (JP) .
9-303908 11/1997 (JP) .
WO 97/15789 5/1997 (WO) .

OTHER PUBLICATIONS

European Search Report dated Feb. 6, 2001.

*Primary Examiner*—Henry Bennett
*Assistant Examiner*—Chen-Wen Jiang
(74) *Attorney, Agent, or Firm*—Nixon Peabody LLP; Donald R. Studebaker

(57) ABSTRACT

A closed circuit (13) is formed such that the upper ends of preinstalled refrigerant pipes (2A, 2B) in a refrigerant circuit are connected to each other through an upper connecting passage (11) and the lower ends thereof are connected to each other through a lower connecting passage (12). A refrigerant is charged into the closed circuit (13). In a separator (50) of the lower connecting passage (12), a separating heat exchange coil (52) heats the liquid refrigerant to evaporate it, and a filter (53) captures foreign substance from the gas refrigerant. Two conveying heat exchangers (7A, 7B) of the lower connecting passage (12) alternately carry out a repetitive cooling operation of cooling the gas refrigerant, having been changed in phase by the separator (50), to change the phase from gas to liquid and a repetitive pressurizing operation of pressurizing the liquid refrigerant by heating the refrigerant to the extent kept in the liquid phase, respectively, thereby applying a running force to the refrigerant. The refrigerant cleans the preinstalled refrigerant pipes (2A, 2B) in a manner of circulating in the closed circuit (13) from the conveying heat exchangers (7A, 7B).

27 Claims, 8 Drawing Sheets

U.S. PATENT DOCUMENTS

| | | | | |
|---|---|---|---|---|
| 5,050,401 | * | 9/1991 | Van Steenburgh, Jr. | 62/292 |
| 5,117,641 | | 6/1992 | Keltner . | |
| 5,127,239 | | 7/1992 | Manz et al. . | |
| 5,167,126 | | 12/1992 | Cartwright . | |
| 5,186,017 | * | 2/1993 | Hancock et al. | 62/292 |
| 5,203,177 | * | 4/1993 | Manz et al. | 62/149 |
| 5,245,840 | * | 9/1993 | Van Steenburgh, Jr. | 62/292 |
| 5,247,812 | * | 9/1993 | Keltner | 62/475 |
| 5,327,741 | * | 7/1994 | Mason et al. | 62/149 |
| 5,357,768 | * | 10/1994 | Van Steenburgh, Jr. | 62/292 |
| 5,377,499 | * | 1/1995 | Zugibe | 62/195 |
| 5,415,003 | * | 5/1995 | Bertva et al. | 62/85 |
| 5,471,848 | * | 12/1995 | Major et al. | 62/149 |
| 5,497,625 | | 3/1996 | Manz et al. . | |
| 5,533,359 | | 7/1996 | Muston et al. . | |
| 5,671,605 | * | 9/1997 | Helterbrand | 62/85 |
| 5,761,924 | * | 6/1998 | Peckjian | 62/292 |
| 6,065,302 | | 5/2000 | Sada et al. . | |

* cited by examiner

METHOD FOR CLEANING PIPE AND PIPE CLEANING APPARATUS FOR REFRIGERATING APPARATUS

TECHNICAL FIELD

This invention relates to a method for cleaning a pipe for a refrigerating apparatus and a pipe cleaning apparatus for a refrigerating apparatus, and particularly relates to measures for cleaning preinstalled refrigerant pipes.

BACKGROUND ART

There are known a large number of conventional air conditioners serving as refrigerating apparatuses. An example of such conventional air conditioners is formed such that a compressor, a four-way selector valve, an outdoor heat exchanger, a motor-operated expansion valve, a receiver and an indoor heat exchanger are connected in this order through refrigerant pipes, as disclosed in Japanese Patent Application Laid-Open Gazette No. 8-100944. This air conditioner is designed for cooling and heating operations.

<Problems to be Solved>

In renewing various kinds of air conditioners including the above-mentioned air conditioner, preinstalled refrigerant pipes are sometimes used while being left in place. In such cases, if a refrigerant in a preinstalled refrigerant circuit and a refrigerant in a newly installed refrigerant circuit are the same CFC (chlorofluorocarbon) or HCFC (hydrochlorofluorocarbon) refrigerants, the preinstalled refrigerant pipes can be used for the new refrigerant circuit without causing so much of a problem.

For newly installed refrigerant circuits, however, a HFC (hydrofluorocarbon) refrigerant for example is proposed to be substituted for the conventional CFC or HCFC refrigerant in consideration of recent environmental problems and the like.

In this case, in order that the preinstalled refrigerant pipes are used for a new refrigerant circuit while being left in place, the insides of the refrigerant pipes must be cleaned. Specifically, lubricating oil or contaminants often deposit on the inner surfaces of the preinstalled refrigerant pipes. In particular, though mineral oil is used as lubricating oil for the conventional CFC refrigerant or the like, synthetic oil is used as lubricating oil for the HFC refrigerant. Accordingly, if the mineral-type lubricating oil is left in the preinstalled refrigerant pipe, foreign substance (contamination) will occur in the newly installed refrigerant circuit. Such foreign substance may cause problems such as closure of a throttling mechanism and damage to a compressor (41).

However, any technique for cleaning the preinstalled refrigerant pipes has not yet been proposed. Therefore, there is a demand for developing a new cleaning means for cleaning the preinstalled refrigerant pipes when the preinstalled refrigerant pipes are used for a new refrigerant circuit while being left in place.

The present invention has been made in view of the above point, and has its object of providing a new pipe cleaning method and a new pipe cleaning apparatus for a preinstalled refrigerant circuit in the case of using preinstalled refrigerant pipes for a new refrigerant circuit while leaving them in place.

DISCLOSURE OF INVENTION

In this invention, a closed circuit (13) is formed such that the upper ends of preinstalled refrigerant pipes (2A, 2B) in a refrigerant circuit are connected to each other through an upper connecting passage (11) and the lower ends thereof are connected to each other through a lower connecting passage (12). A refrigerant is charged into the closed circuit (13). In a separator (50) of the lower connecting passage (12), a separating heat exchange coil (52) heats the liquid refrigerant to evaporate it and a filter (53) captures foreign substance from the gas refrigerant. Two conveying heat exchangers (7A, 7B) of the lower connecting passage (12) alternately carry out a repetitive cooling operation of cooling the gas refrigerant, having been changed in phase by the separator (50), to change the phase from gas to liquid and a repetitive pressurizing operation of pressurizing the liquid refrigerant by heating the refrigerant to the extent kept in the liquid phase, respectively, thereby giving a running force to the refrigerant. The refrigerant cleans the preinstalled refrigerant pipes (2A, 2B) by circulating through the closed circuit (13) from the conveying heat exchangers (7A, 7B).

<Solutions>

Specifically, as shown in FIG. 1, a first solution taken in the present invention is directed to a pipe cleaning method for a refrigerating apparatus in which refrigerant pipes (2A, 2B) in a refrigerant circuit is cleaned.

The method includes a first step of forming a single closed circuit (13) by a connecting passage (12) for cleaning and the refrigerant pipes (2A, 2B) in the refrigerant circuit by connecting the connecting passage (12) to at least one ends of the refrigerant pipes (2A, 2B) and charging a refrigerant into the closed circuit (13).

Further, the method includes a second step of cleaning the refrigerant pipes (2A, 2B) by circulating the refrigerant in the closed circuit (13) so that the refrigerant in the liquid phase flows through the refrigerant pipes (2A, 2B) by means of conveying means (40) provided in the connecting passage (12).

In addition, the method includes, after the cleaning step, a third step of detaching the connecting passage (12) from the refrigerant pipes (2A, 2B).

In a second solution of the present invention, the first solution is adapted such that the second step includes circulating the refrigerant in the closed circuit (13) and concurrently separating foreign substance from the refrigerant by separating means (50).

In a third solution of the present invention, the second solution is adapted such that the second step includes heating a liquid refrigerant by the separating means (50) during the passage of the refrigerant through the connecting passage (12) to change the phase thereof from liquid to gas thereby separating foreign substance from the refrigerant, cooling the gas refrigerant to change the phase thereof from gas to liquid again, and then delivering the liquid refrigerant to the refrigerant pipes (2A, 2B) by the conveying means (40).

In a fourth solution of the present invention, the second solution is adapted such that the second step includes: a first separating operation of heating the liquid refrigerant by the separating means (50) during the passage thereof through the connecting passage (12) to change the phase thereof from liquid to gas thereby separating foreign substance from the refrigerant; a second separating operation of capturing the foreign substance from the gas refrigerant; cooling the gas refrigerant to change the phase thereof from gas to liquid again; and then delivering the liquid refrigerant to the refrigerant pipes (2A, 2B) by the conveying means (40).

In a fifth solution of the present invention, the third or fourth solution is adapted such that the conveying means (40) in the second step performs a cooling operation of cooling the gas refrigerant, having been changed in phase by the separating means (50), to change the phase thereof from gas to liquid again and a conveying operation of delivering the liquid refrigerant to the refrigerant pipes (2A, 2B).

In a sixth solution of the present invention, the fifth solution is adapted such that the conveying means (40) includes two conveying heat exchangers (7A, 7B) each provided at some midpoint of the connecting passage (12) and connected in parallel with each other, and the two conveying heat exchangers (7A, 7B) alternately carry out a repetitive cooling operation of cooling the gas refrigerant, having been changed in phase by the separating means (50), to change the phase thereof from gas to liquid and a repetitive pressurizing operation of pressurizing the liquid refrigerant by heating the refrigerant to the extent kept in the liquid phase, respectively, so that the pressurizing operation causes the liquid refrigerant to be delivered to the refrigerant pipes (2A, 2B).

In a seventh solution of the present invention, the first solution is adapted such that the second step includes circulating the refrigerant from the conveying means (40) to the liquid-refrigerant pipe (2A) through the gas-refrigerant pipe (2B) in the refrigerant circuit.

In an eighth solution of the present invention, the first solution is adapted such that the first step includes charging the refrigerant into the closed circuit (13) from a refrigerant bomb (91) through a charging passage (9S), and the third step includes recovering the refrigerant to the refrigerant bomb (91) from the closed circuit (13) through a recovery passage (9R) and then detaching the connecting passage (12) from the refrigerant pipes (2A, 2B).

In a ninth solution of the present invention, the first solution is adapted such that the refrigerant for cleaning charged into the closed circuit (13) is the same as charged into a new refrigerant circuit constituted by the cleaned refrigerant pipes (2A, 2B).

In a tenth solution of the present invention, the first solution is adapted such that the refrigerant charged into the closed circuit (13) is an HFC (hydrofluorocarbon) refrigerant, an HC (hydrocarbon) refrigerant or an FC (fluorocarbon) refrigerant.

An eleventh solution of the present invention is directed to a pipe cleaning apparatus for a refrigerating apparatus in which refrigerant pipes (2A, 2B) in a refrigerant circuit are cleaned.

And, the pipe cleaning apparatus is provided with a connecting passage (12) for cleaning which is connected to at least one ends of the refrigerant pipes (2A, 2B) in the refrigerant circuit to constitute a closed circuit (13) together with the refrigerant pipes (2A, 2B).

In addition, the connecting passage (12) is provided with conveying means (40) for applying a running force to the refrigerant charged into the closed circuit (13) so that the refrigerant circulates in the closed circuit (13) and the liquid refrigerant cleans the refrigerant pipes (2A, 2B) by the flow thereof through the refrigerant pipes (2A, 2B).

A twelfth solution of the present invention is composed so that in the eleventh solution, the connecting passage (12) is provided with separating means (50) for separating foreign substance from the refrigerant circulating in the closed circuit (13).

A thirteenth solution of the present invention is composed so that in the twelfth solution, the separating means (50) separates foreign substance from the refrigerant by capturing the foreign substance during the passage of the refrigerant in the liquid phase therethrough.

A fourteenth solution of the present invention is composed so that in the twelfth solution, the separating means (50) includes: a tank (51) for storing the liquid refrigerant having circulated in the closed circuit (13); and a heating part (52), accommodated in the tank (51), for evaporating the liquid refrigerant in the tank (51) by heating to separate foreign substance therefrom.

A fifteenth solution of the present invention is composed so that in the twelfth solution, the separating means (50) includes: a tank (51) for storing the liquid refrigerant having circulated in the closed circuit (13); a heating part (52), accommodated in the tank (51), for evaporating the liquid refrigerant in the tank (51) by heating; and a capturing part (53) for allowing the flow of the gas refrigerant and capturing foreign substance in the gas refrigerant.

A sixteenth solution of the present invention is composed so that in the fourteenth or fifteenth solution, the connecting passage (12) is provided with cooling means (84) for cooling the gas refrigerant, having been changed in phase by the separating means (50), to change the phase thereof from gas to liquid and delivering the liquid refrigerant to the conveying means (40).

A seventeenth solution of the present invention is composed so that in the fourteenth or fifteenth solution, the conveying means (40) carries out a cooling operation of cooling the gas refrigerant, having been changed in phase by the separating means (50), to change the phase thereof from gas to liquid and a conveying operation of delivering the liquid refrigerant to the refrigerant pipes (2A, 2B).

An eighteenth solution of the present invention is composed so that in the eleventh solution, the conveying means (40) is a conveying pump (80) for circulating the refrigerant kept in the liquid phase through the entire closed circuit (13).

A nineteenth solution of the present invention is composed so that in the eleventh solution, the conveying means (40) includes: cooling means (81), provided in a first connecting passage (11) for cleaning connected to the refrigerant pipes (2A, 2B), for cooling the refrigerant for depressurization thereby recovering the refrigerant in the liquid phase; and pressurizing means (82), provided in a second connecting passage (12) for cleaning connected to the refrigerant pipes (2A, 2B) and placed below at least the cooling means (81), for pressurizing the liquid refrigerant by heating to drive off the liquid refrigerant.

A twentieth solution of the present invention is composed so that in the seventeenth solution, the cooling means (81) is provided in a first connecting passage (11) for cleaning connected to one ends of the refrigerant pipes (2A, 2B), is placed above the refrigerant pipes (2A, 2B), recovers the liquid refrigerant rising up through the refrigerant pipe (2B) and runs the liquid refrigerant downflow through the refrigerant pipe (2A) by gravity, and the pressurizing means (82) is provided in a second connecting passage (12) for cleaning connected to the other ends of the refrigerant pipes (2A, 2B), is placed below the refrigerant pipes (2A, 2B), recovers the liquid refrigerant falling down through the refrigerant pipe (2A) and runs the liquid refrigerant upflow through the refrigerant pipe (2B) by pressurization.

A twenty-first solution of the present invention is composed so that in the eleventh, fourteenth, fifteenth or eighteenth solution, the conveying means (40) includes two conveying heat exchangers (7A, 7B) each provided at some midpoint of the connecting passage (12) and connected in parallel with each other, and the two conveying heat exchangers (7A, 7B) alternately carry out a repetitive cooling operation of cooling the gas refrigerant, having been changed in phase by the separating means (50), to change the phase thereof from gas to liquid and a repetitive pressurizing operation of pressurizing the liquid refrigerant by heating the refrigerant to the extent kept in the liquid phase, whereby the cooling operation causes the refrigerant to be recovered and the pressurizing operation cause the liquid refrigerant to be delivered to the refrigerant pipes (2A, 2B).

A twenty-second solution of the present invention is composed so that in the twenty-first solution, the heating part (52) of the separating means (50) is formed of a separating heat exchange coil (52), and the separating heat exchange coil (52) is connected to the two conveying heat exchangers (7A, 7B) of the conveying means (40) to constitute a single refrigerating circuit (4R) for cleaning where a primary refrigerant circulates separately from the closed circuit (13) so that the primary refrigerant heat-exchanges with a secondary refrigerant circulating in the closed circuit (13). In addition, the refrigerating circuit (4R) for cleaning includes: a conveying passage section (4A) in which conveying refrigerant passages (71, 72) for passing the primary refrigerant therethrough are formed in the conveying heat exchangers (7A, 7B), respectively, and are connected in series to each other through a throttling mechanism (44); a separating passage section (4B) which is communicated with the conveying passage section (4A) and in which the separating heat exchange coil (52) is connected in series to the discharge side of the compressor (41); and selecting means (42) for changing the direction of refrigerant flow in the conveying passage section (4A) with respect to the separating passage section (4B) so that repetitive condensation and evaporation of the primary refrigerant are alternately provided by the conveying heat exchangers (7A, 7B), respectively.

A twenty-third solution of the present invention is composed so that in the twenty-second solution, the refrigerating circuit (4R) for cleaning changes the direction of refrigerant flow in the conveying passage section (4A) when the discharge pressure of the compressor (41) becomes equal to or above a predetermined value, or when the discharge temperature of the compressor (41) becomes equal to or below a predetermined value, or when the internal pressure of the separating means (50) becomes equal to or above a predetermined value.

A twenty-fourth solution of the present invention is composed so that in the twenty-first solution, the heating part (52) of the separating means (50) is formed of a separating heat exchange coil (52), and the separating heat exchange coil (52) is connected to the two conveying heat exchangers (7A, 7B) of the conveying means (40) to constitute a single refrigerating circuit (4R) for cleaning where a primary refrigerant circulates separately from the closed circuit (13) so that the primary refrigerant heat-exchanges with a secondary refrigerant circulating in the closed circuit (13). In addition, the refrigerating circuit (4R) for cleaning includes: a conveying passage section (4A) including conveying refrigerant passages (71, 72), formed in the conveying heat exchangers (7A, 7B), respectively, for passing the primary refrigerant therethrough, the separating heat exchange coil (52) and a throttling mechanism (44); a compression passage section (4C) including the compressor (41) and communicated with the conveying passage section (4A); and selecting means (42) for changing the direction of refrigerant flow in the conveying passage section (4A) with respect to the compression passage section (4C) so that repetitive condensation and evaporation of the primary refrigerant are alternately provided by the conveying heat exchangers (7A, 7B), respectively. Further, the conveying passage section (4A) is configured so that the primary refrigerant is condensed by one of the conveying heat exchangers (7A or 7B), flows through the separating heat exchange coil (52), is reduced in pressure by the throttling mechanism (44) and is evaporated by the other conveying heat exchanger (7A or 7B).

A twenty-fifth solution of the present invention is composed so that in the twenty-fourth solution, the compression passage section (4C) has an air-cooled condenser (4*e*), provided on the discharge side of the compressor (41), for condensing the primary refrigerant discharged from the compressor (41).

A twenty-sixth solution of the present invention is composed so that in the twenty-fifth solution, the air-cooled condenser (4*e*) drives an air-cooling fan (4*f*) when the discharge pressure of the compressor (41) becomes equal to or above a predetermined value.

A twenty-seventh solution of the present invention is composed so that in the twenty-fourth solution, the refrigerating circuit (4R) for cleaning is configured so that the selecting means (42) changes the direction of refrigerant flow in the conveying passage section (4A) when the suction pressure of the compressor (41) becomes equal to or below a predetermined value.

A twenty-eighth solution of the present invention is composed so that in the twenty-fourth solution, the refrigerating circuit (4R) for cleaning is provided with a differential pressure control passage (49) bypassing the separating heat exchange coil (52) and including a shut-off valve (SV).

A twenty-ninth solution of the present invention is composed so that in the twenty-second or twenty-fourth solution, the connecting passage (12) is provided with a charging passage (9S) for charging the secondary refrigerant into the closed circuit (13) from a refrigerant bomb (91) before cleaning is carried out, and a recovery passage (9R) for recovering the secondary refrigerant from the closed circuit (13) to the refrigerant bomb (91) after cleaning is carried out.

A thirtieth solution of the present invention is composed so that in the twenty-second or twenty-fourth solution, the connecting passage (12) is provided with a hot gas passage (15) for ducting the secondary refrigerant of high temperature and high pressure from the upstream side of the conveying heat exchangers (7A, 7B) when cleaning is completed to supply the ducted secondary refrigerant to the downstream side of the conveying heat exchangers (7A, 7B).

A thirty-first solution of the present invention is composed so that in the eleventh solution, the connecting passage (12) is configured so that the refrigerant circulates from the conveying means (40) to the liquid-refrigerant pipe (2A) through the gas-refrigerant pipe (2B) in the refrigerant circuit.

A thirty-second solution of the present invention is composed so that in the eleventh solution, the cleaning refrigerant charged into the closed circuit (13) is the same as charged into a new refrigerant circuit constituted by the cleaned refrigerant pipes (2A, 2B).

A thirty-third solution of the present invention is composed so that in the eleventh solution, the refrigerant charged into the closed circuit (13) is an HFC refrigerant, an HC refrigerant or an FC refrigerant.

<Operation>

With the above-mentioned features of the present invention, in the first and eleventh solutions, outdoor and indoor units are removed from the refrigerant pipes (2A, 2B) in the preinstalled refrigerant circuit, and the connecting passage (12) is connected to at least one ends of the refrigerant pipes (2A, 2B) to constitute a closed circuit (13). Then, a cleaning refrigerant is charged into the closed circuit (13). In this case, in the eighth and twenty-ninth solutions, the refrigerant is charged into the closed circuit (13) from the refrigerant bomb (91) through the charging passage (9S).

In the ninth and thirty-second solutions, the refrigerant charged into the closed circuit (13) is the same as charged into a new refrigerant circuit constituted by the cleaned refrigerant pipes (2A, 2B). In the tenth and thirty-third solutions, any one of an HFC refrigerant, an HC refrigerant and an FC refrigerant is charged into the closed circuit (13), thereby completing the first step.

Subsequently, the conveying means (40) in the connecting passage (12) is driven for circulation of the refrigerant. For example, in the third, fourth and eighteenth solutions, driving the conveying pump (80) causes circulation of the refrigerant. Alternatively, in the nineteenth and twenty-first solutions, driving the cooling and pressurizing means (81, 82) and using the gravity cause circulation of the refrigerant.

Further, in the fourth, fifth, sixth, twenty-first and twenty-second solutions, for example, the compressor (41) of the refrigerating circuit (4R) for cleaning is driven so that a primary refrigerant is circulated in the refrigerating circuit (4R) for cleaning. In the refrigerating circuit (4R) for cleaning, the refrigerant of high temperature and high pressure, discharged from the compressor (41), flows into the separating means (50). For example, in the third, fourth, fourteenth and fifteenth solutions, the refrigerant flows into the separating heat exchange coil (52) of the separating means (50) and evaporates a secondary refrigerant in the liquid phase for cleaning stored in the tank (51) of the separating means (50). Thereafter, the primary refrigerant, having passed through the separating heat exchange coil (52), flows into one of the conveying heat exchanger (7A).

Specifically, the primary refrigerant of high temperature, having passed through the separating heat exchange coil (52) of the separating means (50), flows into the first conveying heat exchanger (7A), and is condensed therein to heat the secondary refrigerant in the liquid phase and increase the pressure thereof. This pressure increase allows the secondary refrigerant to obtain a running force while being kept in the liquid phase, so that the secondary refrigerant flows out of the first conveying heat exchanger (7A) and then flows through the refrigerant pipes (2A, 2B). Particularly, in the seventh and thirty-first solutions, the secondary refrigerant is circulated from the conveying means (40) through the gas-refrigerant pipe (2B) to the liquid-refrigerant pipe (2A) in the refrigerant circuit.

On the other hand, the primary refrigerant is reduced in pressure in the throttling mechanism (44) and then flows into the second conveying heat exchanger (7B). The primary refrigerant is evaporated therein to cool the cleaning secondary refrigerant in the gas phase thereby turning it into the liquid phase. As a result of this phase change of the secondary refrigerant, the secondary refrigerant is reduced in pressure, which causes the secondary refrigerant in the liquid phase to be stored in the second conveying heat exchanger (7B) while sucking the secondary refrigerant in the gas phase from the separating means (50). Then, the primary refrigerant evaporated in the second conveying heat exchanger (7B) returns to the compressor (41). The primary refrigerant repeats the above operation.

Thereafter, the direction of refrigerant flow in the conveying passage section (4A) of the refrigerating circuit (4R) for cleaning is changed. For example, in the twenty-seventh solution, the direction of refrigerant flow in the conveying passage section (4A) is changed when the discharge pressure of the compressor (41) becomes equal to or above a predetermined value, or when the discharge temperature of the compressor (41) becomes equal to or below a predetermined value, or when the internal pressure of the separating means (50) becomes equal to or above a predetermined value. As a result of this change in the direction of refrigerant flow, the primary refrigerant of high temperature, having passed through the separating heat exchange coil (52) of the separating means (50), flows into the second conveying heat exchanger (7B) to deliver the cleaning secondary refrigerant to the refrigerant pipes (2A, 2B). Then, the primary refrigerant is evaporated by the first conveying heat exchanger (7A) to cool the cleaning secondary refrigerant and store it in the first conveying heat exchanger (7A). The primary refrigerant repeats such an operation to circulate the secondary refrigerant in the closed circuit (13).

Alternatively, in the twenty-fourth solution, for example, the refrigerant of high temperature and high pressure, discharged from the compressor (41), flows through the first conveying heat exchanger (7A) and is condensed therein to heat the secondary refrigerant in the liquid phase for increase in pressure thereof. Thereafter, the two-phase primary refrigerant partly in the gas phase and partly in the liquid phase, part of which has been condensed, flows into the separating heat exchange coil (52) of the separating means (50), and evaporates the cleaning secondary refrigerant in the liquid phase stored in the tank (51) of the separating means (50). The primary refrigerant is reduced in pressure by the throttling mechanism (44), flows into the second conveying heat exchanger (7B), and is evaporated therein to cool the secondary refrigerant in the gas phase thereby turning it into the liquid phase. As a result of this phase change of part of the secondary refrigerant, the secondary gas refrigerant in the separating means (50) is sucked and the secondary liquid refrigerant is stored in the second conveying heat exchanger (7B). Then, the primary refrigerant evaporated by the second conveying heat exchanger (7B) returns to the compressor (41). The primary refrigerant repeats such an operation.

Further, in the twenty-seventh solution, when the suction pressure of the compressor (41) becomes equal to or below a predetermined value, the direction of refrigerant flow in the conveying passage section (4A) is changed. This causes the second conveying heat exchanger (7B) to condense the primary refrigerant therein and deliver the secondary refrigerant therein to the refrigerant pipes (2A, 2B), and then causes the first conveying heat exchanger (7A) to evaporate the primary refrigerant therein and store the secondary refrigerant therein. The primary refrigerant repeats such an operation to circulate the secondary refrigerant in the closed circuit (13).

Alternatively, in the twenty-fifth and twenty-sixth solutions based on the twenty-fourth solution, when the discharge pressure of the compressor (41) becomes equal to or above a predetermined value, the air-cooling fan (**4*f*) is driven to condense the primary refrigerant in the air-cooled condenser (4*e***) thereby reducing the discharge pressure.

Alternatively, in the twenty-eighth solution based on the twenty-fourth solution, the shut-off valve (SV) of the differential pressure control passage (49) bypassing the separating heat exchange coil (52) is opened or closed to reduce the amount of heat exchange between the primary and secondary refrigerants in the separating heat exchange coil (52). This reduces the pressure of refrigerant in the tank (51) of the separating means (50) and thereby a differential pressure can be secured between the separating means (50) and the conveying heat exchanger (7A or 7B) out of which the secondary refrigerant is delivered.

Through the circulation of the secondary refrigerant in the liquid phase, foreign substance such as lubricating oil deposited onto the inner surfaces of the refrigerant pipes (2A, 2B) blends in the secondary refrigerant. And, in the second and thirteenth solutions, during the circulation of the secondary refrigerant in which the foreign substance blends, the foreign substance is captured by the separating means (50) when the secondary refrigerant passes through the separating means (50).

Particularly, in the third and fourteenth solutions, the secondary refrigerant in which the foreign substance blends flows into the separating means (50). In the separating means (50), the secondary refrigerant is evaporated through the application of heat from the separating heat exchange coil (52) to turn into the gas phase as described above. As a result, the foreign substance is separated from the secondary refrigerant and deposited on the bottom inside of the tank (51). Cleaning the refrigerant pipes (2A, 2B) is carried out in this manner. When this cleaning operation is completed, the second step is complete.

Alternatively, in the fourth and fifteenth solution, the secondary refrigerant in which the foreign substance blends flows into the tank (51) of the separating means (50). This secondary refrigerant in the liquid phase is evaporated through the application of heat from the separating heat exchange coil (52) to turn into the gas phase as described above. As a result, the foreign substance is separated from the secondary refrigerant and deposited on the bottom inside of the tank (51). Further, when the secondary refrigerant in the gas phase passes through the capturing part (53), foreign substance such as lubricating oil blending in the secondary refrigerant is removed so that the secondary refrigerant is provided as clean one. This clean secondary refrigerant flows into one of the conveying heat exchangers (7A, 7B) as described above. The secondary refrigerant repeats such an operation. When this cleaning operation is completed, the second step is complete.

Further, in the first and eleventh solutions, the refrigerant pipes (2A, 2B) are cleaned in such a manner that foreign substance blends in the secondary refrigerant. When this cleaning operation is completed, the second step is complete.

At the completion of the cleaning operation, in the thirtieth solution, the secondary refrigerant of high temperature and high pressure is delivered from the upstream sides of the conveying heat exchanger (7A, 7B) to the downstream sides thereof through the hot gas passage (15). This results in evaporation of the secondary refrigerant in the liquid phase left in the refrigerant pipes (2A, 2B).

Thereafter, in the eighth and twenty-ninth solutions, the refrigerant is recovered to the refrigerant bomb (91) from the closed circuit (13) through the recovery passage (9R). Then, the upper connecting passage (11) and the second connecting passage (12) are detached from the refrigerant pipes (2A, 2B), thereby completing the third step.

<Effects of the Invention>

According to the present invention, since the refrigerant pipes (2A, 2B) in the refrigerant circuit can be cleaned, the preinstalled or newly installed refrigerant pipes (2A, 2B) can be cleaned with reliability. Such a cleaning allows, for example, the preinstalled refrigerant pipes (2A, 2B) to be used for a newly installed air conditioner while being left in place. As a result, the installation of an air conditioner can be simplified and reduced in cost.

Particularly, when an HFC refrigerant for example is used for a newly installed air conditioner, production of foreign substance can securely be prevented. This obviates the clogging of a capillary tube or the like, thereby ensuring the reliability of the air conditioner.

Furthermore, since the preinstalled refrigerant pipes (2A, 2B) can be used while being left in place, it is not necessary to strip part of walls and ceilings of the building in installing a new air conditioner. This allows a prompt installation of the new air conditioner and ensures the reliability thereof.

In addition, since the preinstalled refrigerant pipes (2A, 2B) are reused, this realizes recycling of such an existent resource.

According to the fifteenth solution, since the separating means (50) heats the refrigerant at the heating part (52) and captures foreign substance at the capturing part (53), foreign substance such as lubricating oil can securely be removed.

According to the eighteenth solution, since the conveying means (40) is formed of a conveying pump (80) for conveying a refrigerant, the cleaning refrigerant can be circulated with a simple structure.

According to the nineteenth and twentieth solutions, since the conveying means (40) is composed of the cooling means (81) and the pressurizing means (82), the cleaning refrigerant can be circulated with small conveying power.

According to the twenty-first and twenty-second solutions, since the secondary refrigerant is conveyed in such a manner that the two conveying heat exchangers (7A, 7B) in the refrigerating circuit (4R) for cleaning alternately carry out repetitive cooling and pressurizing operations, respectively, this provides a high-reliability conveyance of refrigerant.

According to the twenty-second solution, since the refrigerating circuit (4R) for cleaning is formed of a single refrigerating circuit and the refrigerant is conveyed by means of a system using a secondary refrigerant, this provides a high-reliability conveyance of refrigerant with low power.

According to the twenty-third solution, since the direction of refrigerant circulation in the conveying passage section (4A) of the refrigerating circuit (4R) for cleaning is changed depending upon the discharge pressure of the compressor (41) or other factors, circulation of the cleaning refrigerant can be made with reliability.

According to the twenty-fourth solution, since the primary refrigerant, part of which has been condensed in one of the conveying heat exchangers (7A or 7B), is further condensed by the separating heat exchange coil (52), a sufficient amount of heat for pressurizing the secondary refrigerant can be secured. This allows the secondary refrigerant to be circulated in the closed circuit (13) with reliability.

In particular, for the use of an HFC refrigerant as the secondary refrigerant, some HFC refrigerants have temperature gradients with respect to the isobaric line between the saturated liquid line and the saturated vapor line in the Mollier diagram. Therefore, if the condensation temperature of the primary refrigerant is constant, the pressure of the secondary refrigerant evaporating in the separator (50) becomes lower than that of the secondary refrigerant flowing out of the conveying heat exchanger (7A or 7B). As a result, the secondary refrigerant can be circulated in the closed circuit (13) with reliability.

According to the twenty-fifth and twenty-sixth solutions, since the compression passage section (4C) is provided with an air-cooled condenser (4*e*), condensation and heat radiation can be made on the primary refrigerant with reliability. This securely prevents an excessive rise in the pressure of the high-pressure refrigerant in the refrigerating circuit (4R) for cleaning.

According to the seventh and thirty-first solutions, since the secondary refrigerant is passed into the preinstalled liquid-refrigerant pipe (2A) of smaller diameter from the preinstalled gas-refrigerant pipe (2B) of larger diameter, the secondary refrigerant can be circulated without expanding halfway therebetween. Accordingly, the secondary refrigerant can be circulated while being kept in the liquid phase, thereby suppressing the decrease in the cleaning efficiency.

According to the twenty-eighth solution, since the differential pressure control passage (49) is provided through which the primary refrigerant bypasses the separating heat exchange coil (52), the pressure of the secondary refrigerant in the separator (50) can be lowered than that of the secondary refrigerant in one of the conveying heat exchangers (7A or 7B) that delivers the primary refrigerant by pressurization. This ensures a differential pressure between the conveying heat exchanger (7A or 7B) and the separator (50) with reliability. As a result, the secondary refrigerant can securely be circulated.

According to the thirtieth solution, since the hot gas passage (15) is provided, the residual secondary refrigerant in the preinstalled refrigerant pipes (2A, 2B) at the completion of cleaning can securely be evaporated and recovered.

BEST MODE FOR CONVEYING OUT THE INVENTION

Hereinafter, embodiments of the present invention will be described in detail with reference to the drawings.

<Embodiment 1>

Figure 1:
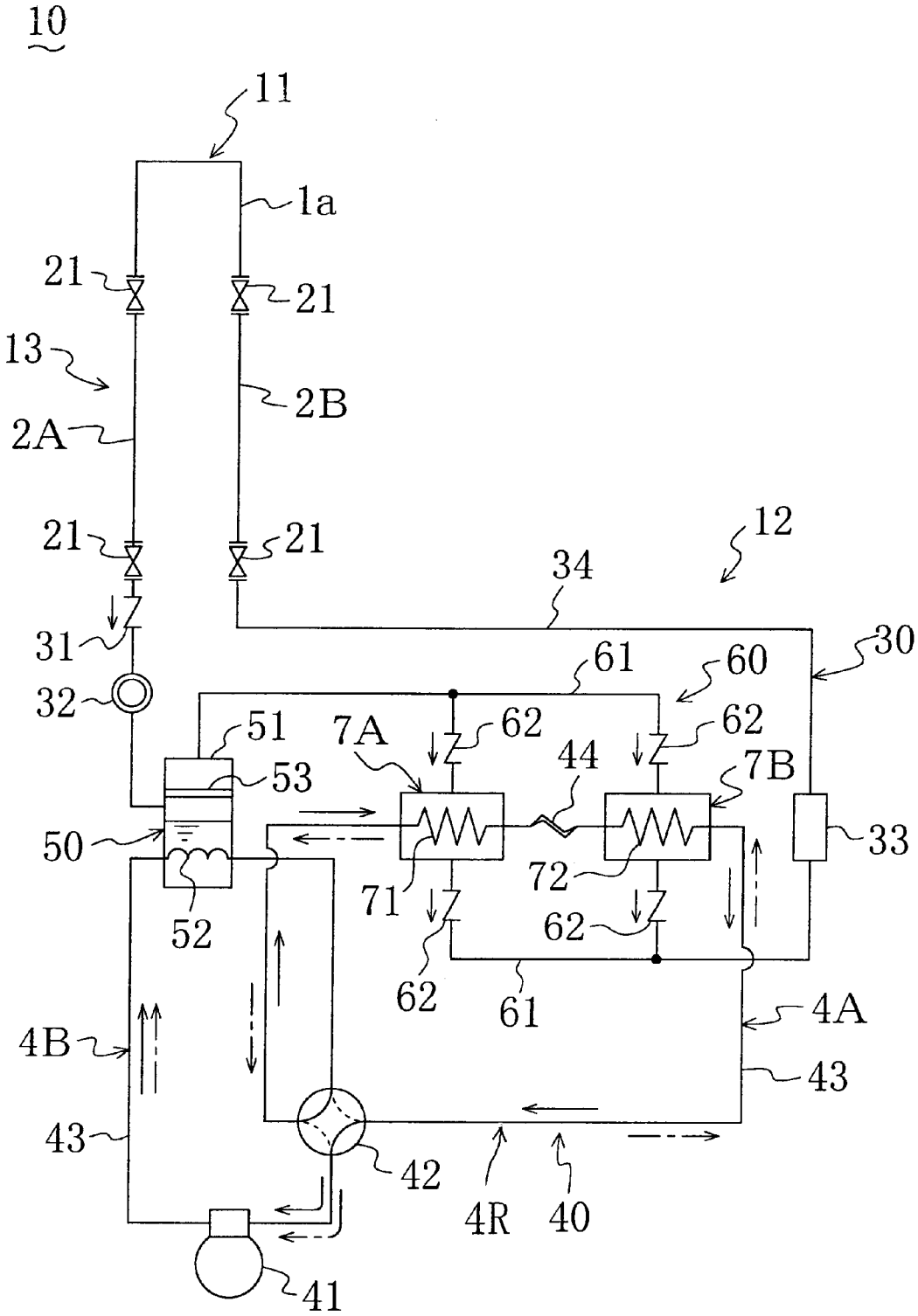
FIG. 1 is a refrigerant circuit diagram showing Embodiment 1 of the present invention.

As shown in FIG. 1, a pipe cleaning apparatus is for cleaning refrigerant pipes (2A, 2B) in a preinstalled refrigerant circuit by means of a system using a secondary refrigerant, and therefore is connected to the preinstalled refrigerant pipes (2A, 2B). In FIG. 1, two preinstalled refrigerant pipes (2A, 2B) are illustrated. These preinstalled refrigerant pipes (2A, 2B) are interconnection pipes for interconnecting an outdoor unit and an indoor unit in the unshown preinstalled refrigerant circuit, and shown as vertical pipes in this embodiment.

The above two preinstalled refrigerant pipes (2A, 2B) are connected at upper ends thereof to an upper connecting passage (11) as a first connecting passage and at lower ends thereof to an lower connecting passage (12) as a second connecting passage. The upper connecting passage (11) is formed of a single connecting pipe (1*a*), both ends of which are connected to the upper ends of the two preinstalled refrigerant pipes (2A, 2B) through the couplings (21, 21), respectively. Such connecting portions of the upper connecting passage (11) are, for example, portions to which an indoor unit has been connected in the preinstalled refrigerant circuit.

The lower connecting passage (12) is composed of an interconnection passage (30) for cleaning and a refrigerating circuit (4R) for cleaning. Both ends of the interconnection passage (30) for cleaning are connected to the lower ends of the preinstalled refrigerant pipes (2A, 2B) through couplings (21, 21). Thus, the two preinstalled refrigerant pipes (2A, 2B), the upper connecting passage (11) and the interconnection passage (30) for cleaning of the lower connecting passage (12) constitute a closed circuit (13). The connecting portions of the interconnection passage (30) for cleaning are, for example, portions to which an outdoor unit has been connected in the preinstalled refrigerant circuit.

A cleaning secondary refrigerant for cleaning the preinstalled refrigerant pipes (2A, 2B) is charged into the closed circuit (13). As the secondary refrigerant, for example, a new clean refrigerant to be used for a newly installed air conditioner is adopted. Specifically, the secondary refrigerant is an HFC refrigerant such as R-407C and R-410A. The secondary refrigerant used to clean the preinstalled refrigerant pipes (2A, 2B) needs to satisfy requirements of (a) small latent heat of evaporation, i.e., evaporation by a small heating and condensation by a small cooling, (b) a small specific gravity in the liquid phase, i.e., small energy of liquid circulation, and (c) a good solvent for lubricating oil.

The interconnection passage (30) for cleaning is constructed such that a non-return valve (31), a sight glass (32) for verification of cleaning, a separator (50), a pressure increasing/reducing part (60) and a dryer (33) are connected in this order through a connecting pipe (34). The non-return valve allows only refrigerant flow toward the separator (50). The sight glass (32) is a window for mainly determining whether or not lubricating oil is removed according to the viscosity of the refrigerant. The dryer (33) doubles as a filter.

The pressure increasing/reducing part (60) is constructed such that part of the connecting pipe (34) is branched into two parallel passages (61, 61) and the parallel passages (61, 61) are provided with conveying heat exchangers (7A, 7B), respectively. Further, in the pressure increasing/reducing part (60), non-return valves (62, 62, . . . ) are provided on the respective upstream and downstream sides of the conveying heat exchangers (7A, 7B).

The separator (50) is constructed so that a separating heat exchange coil (52) and a filter (53) are accommodated in a tank (51), and constitutes a separating means for separating foreign substance such as lubricating oil from the secondary refrigerant. The tank (51) is for storing the secondary refrigerant in the liquid phase having passed through the preinstalled refrigerant pipes (2A, 2B).

The separating heat exchange coil (52) is connected to the refrigerating circuit (4R) for cleaning, and constitutes a heating part for heating the secondary refrigerant in the liquid phase in the tank (51) to evaporate it. The filter (53) is attached to an upper part inside of the tank (51) and constitutes a capturing part for removing foreign substance from the secondary refrigerant in the gas phase, evaporated by heat from the separating heat exchange coil (52), through the passage of the secondary refrigerant.

The refrigerating circuit (4R) for cleaning constitutes a conveying means (40) in the form of an independent refrigerating circuit consisting of a conveying passage section (4A) and a separating passage section (4B). The conveying passage section (4A) is connected to the separating passage section (4B) such that its direction of refrigerant flow with respect to the separating passage section (4B) can be reversed by a four-way selector valve (42). For a refrigerant charged into the refrigerant circuit (4R) for cleaning, i.e., for a primary refrigerant, various kinds of refrigerants such as R22 and an HFC refrigerant can be used.

The separating passage section (4B) is constructed so that the separating heat exchange coil (52) is connected in series to the discharge side of the compressor (41). The suction side of the compressor (41) is connected to the four-way selector valve (42) through a refrigerating pipe, and the effluent side of the separating heat exchange coil (52) is connected to the four-way selector valve (42). Further, the separating heat exchange coil (52) is accommodated in the tank (51) of the separator (50), as described above. The separating heat exchange coil (52) passes the primary refrigerant of high temperature, discharged from the compressor (41), therethrough to evaporate the secondary refrigerant in the liquid phase in the tank (51). Thus, the conveying means (40) doubles as the heating part for the separator (50).

The conveying passage section (4A) is constructed so that the conveying heat exchange coils (71, 72) of the two conveying heat exchangers (7A, 7B) are connected in series with each other via a refrigerating pipe with a throttling mechanism (44) interposed therebetween. The conveying heat exchange coils (71, 72) of the two conveying heat exchangers (7A, 7B) alternately carry out a repetitive cooling operation of cooling the secondary gas refrigerant, having been changed in phase in the separator (50), to change its phase from gas to liquid and reduce its pressure and a pressurizing operation of increasing the pressure of the secondary refrigerant in the liquid phase by heating the secondary refrigerant to the extent kept in the liquid phase, respectively. In other words, the conveying heat exchange coils (71, 72) constitute a conveying refrigerant passage so as to alternately serve as a cooling means or a pressurizing means, respectively.

More specifically, suppose, for example, that a cleaning secondary refrigerant in the liquid phase is stored in the first conveying heat exchanger (7A) located on the left in FIG. 1 while a cleaning secondary refrigerant in the gas phase is stored in the second conveying heat exchanger (7B) located on the right in FIG. 1. In this state, the first conveying heat exchange coil (71) serves as a pressurizing means, while the second conveying heat exchange coil (72) serves as a cooling means.

Then, the primary refrigerant of high temperature, having passed through the separating heat exchange coil (52), heats the secondary refrigerant in the liquid phase in the first conveying heat exchanger (7A) to increase the pressure thereof and give a running force to the secondary refrigerant. As a result, the secondary refrigerant is delivered to the preinstalled refrigerant pipes (2A, 2B). On the other hand, the primary refrigerant is reduced in pressure by the throttling mechanism (44), and then is evaporated in the second conveying heat exchanger (7B) to cool the secondary refrigerant in the gas phase. The cooled secondary refrigerant turns into the liquid phase and reduces in pressure, which causes the secondary refrigerant in the liquid phase to be stored in the second conveying heat exchanger (7B) while sucking the secondary refrigerant in the gas phase from the separator (50).

Thereafter, the first and second conveying heat exchange coils (71, 72) are changed to cooling and pressurizing means, respectively. In this state, the primary refrigerant of high temperature, having passed through the separating heat exchange coil (52), flows into the second conveying heat exchanger (7B) to drive off the secondary refrigerant in the liquid phase to the preinstalled refrigerant pipes (2A, 2B). Then, the primary refrigerant is evaporated in the first conveying heat exchanger (7A) to cool the secondary refrigerant in the gas phase. The cooled secondary refrigerant is turned into the liquid phase and is stored in the first conveying heat exchanger (7A). These alternate operations are repeated.

The refrigerating circuit (4R) for cleaning is configured so that when the discharge pressure of the compressor (41) becomes equal to or above a predetermined value, or when the discharge temperature of the compressor (41) becomes equal to or below a predetermined value, or when the internal pressure of the separator (50) becomes equal to or above a predetermined value, the four-way selector valve (42) is operated to change the direction of refrigerant flow in the conveying passage section (4A). Specifically, when the entire secondary refrigerant in the liquid phase flows out of one of the conveying heat exchangers (7A, 7B) (the pressurizing-side heat exchanger), the amount of heat exchange of the primary refrigerant is reduced so that the discharge pressure of the compressor (41) is increased. Accordingly, the four-way selector valve (42) is changed in its direction of flow. Alternatively, when the other conveying heat exchanger (7A, 7B) (the cooling-side heat exchanger) is filled with the secondary refrigerant in the liquid phase, the primary refrigerant is sucked into the compressor (41) so that the discharge temperature of the compressor (41) is decreased. Accordingly, the four-way selector valve (42) is changed in its direction of flow. Alternatively, when one of the conveying heat exchangers (7A, 7B) (the cooling-side heat exchanger) is filled with the secondary refrigerant in the liquid phase, the internal pressure of the separator (50) rises to a saturation pressure equivalent to a discharge temperature of the compressor (41). Therefore, the four-way selector valve (42) is changed in its direction of flow. The change in the flow direction of the four-way selector valve (42) allows the secondary refrigerant of high temperature, having passed through the separating heat exchange coil (52), to flow into the other conveying heat exchanger (7A, 7B).

<Cleaning of Preinstalled Refrigerant Pipes (2A, 2B)>

Next, a cleaning operation for the preinstalled refrigerant pipes (2A, 2B) by the above-mentioned pipe cleaning apparatus will be described together with a pipe cleaning method.

First, in the preinstalled refrigerant circuit, indoor and outdoor units are detached from the preinstalled refrigerant pipes (2A, 2B) as interconnection pipes. Then, the upper connecting passage (11) is connected to the upper ends of the two preinstalled refrigerant pipes (2A, 2B), while the cleaning interconnection passage (30) of the lower connecting passage (12) is connected to the lower ends of the two preinstalled refrigerant pipes (2A, 2B). In this manner, the closed circuit (13) is formed. Thereafter, the secondary refrigerant as a cleaning refrigerant is charged into the closed circuit (13), which completes the first step.

Subsequently, in the lower connecting passage (12), the refrigerating circuit (4R) for cleaning is driven. Specifically, the compressor (41) is driven to circulate the primary refrigerant. In the refrigerating circuit (4R) for cleaning, the primary refrigerant of high temperature and high pressure, discharged from the compressor (41), flows into the separating heat exchange coil (52) of the separator (50) to evaporate the secondary refrigerant in the liquid phase stored in the tank (51) of the separator (50). The primary refrigerant is partly condensed by the passage thereof through the separating heat exchange coil (52) to turn into two phases and then flows into one of the conveying heat exchange coils (71, 72) via the four-way selector valve (42).

It is now proposed to begin the description with a state that the cleaning secondary refrigerant in the liquid phase is stored in the first conveying heat exchanger (7A) located on the left in FIG. 1 and the cleaning secondary refrigerant in the gas phase is stored in the second conveying heat exchanger (7B) located on the right in FIG. 1.

In this state, the four-way selector valve (42) is changed to the position shown in the solid lines of FIG. 1 so that the primary refrigerant of high temperature, having passed through the separating heat exchange coil (52), flows into the conveying heat exchange coil (71) of the first conveying heat exchanger (7A). As a result, the primary refrigerant is condensed therein to heat the secondary refrigerant in the liquid phase and increase its pressure. Because of this pressure rise, the secondary refrigerant obtains a running force while being kept in the liquid phase to flow out of the first conveying heat exchanger (7A) into the preinstalled refrigerant pipes (2A, 2B).

Further, the primary refrigerant is depressurized in the throttling mechanism (44) and then flows into the conveying heat exchange coil (72) of the second conveying heat exchanger (7B). In this conveying heat exchange coil (72), the primary refrigerant is evaporated to cool the cleaning secondary refrigerant in the gas phase and change it to the liquid phase. As a result of this phase change, the secondary refrigerant is reduced in pressure, which causes the secondary refrigerant in the liquid phase to be stored in the second conveying heat exchanger (7B) while sucking the secondary refrigerant in the gas phase from the separator (50). Then, the primary refrigerant evaporated in the second conveying heat exchanger (7B) returns to the compressor (41) via the four-way selector valve (42). The primary refrigerant repeats such an operation.

Thereafter, when the entire secondary refrigerant in the liquid phase flows out of the first conveying heat exchanger (7A), the four-way selector vale (42) is changed in its direction of flow. In such a case, for example, the amount of heat exchange of the primary refrigerant in the first conveying heat exchanger (7A) is decreased so that the discharge pressure of the compressor (41) is increased. Therefore, the outflow of the secondary refrigerant is detected and the four-way selector valve (42) is changed in its direction of flow. Alternatively, when the second conveying heat exchanger (7B) (the cooling-side heat exchanger) is filled with the secondary refrigerant in the liquid phase, the primary refrigerant is sucked into the compressor (41) so that the discharge temperature of the compressor (41) is decreased. Therefore, the outflow of the secondary refrigerant is detected and the four-way selector valve (42) is changed in its direction of flow. Alternatively, when the first conveying heat exchanger (7A) (the cooling-side heat exchanger) is filled with the secondary refrigerant in the liquid phase, the internal pressure of the separator (50) rises to a saturated pressure equivalent to a discharge temperature of the compressor (41). Therefore, the outflow of the secondary refrigerant is detected and the four-way selector valve (42) is changed in its direction of flow.

The change in the direction of flow of the four-way selector valve (42) causes the primary refrigerant of high temperature, having passed through the separating heat exchange coil (52), to flow into the second conveying heat exchanger (7B) to deliver the cleaning secondary refrigerant to the preinstalled refrigerant pipes (2A, 2B). Further, the primary refrigerant is evaporated in the first conveying heat exchanger (7A) to cool the cleaning secondary refrigerant and store it in the first conveying heat exchanger (7A). The primary refrigerant repeats such an operation to circulate the secondary refrigerant in the closed circuit (13).

Through the circulation of the secondary refrigerant in the liquid phase, foreign substance such as lubricating oil, deposited on the inner surfaces of the preinstalled refrigerant pipes (2A, 2B), blends in the secondary refrigerant and flows into the tank (51) of the separator (50). As described above, the secondary refrigerant in the liquid phase is evaporated in the tank (51) through the application of heat from the separating heat exchange coil (52) to turn into the gas phase. Accordingly, foreign substance is separated from the secondary refrigerant and deposited on the bottom inside of the tank (51). Further, when the secondary refrigerant in the gas phase passes through the filter (53), foreign substance such as lubricating oil blending in the secondary refrigerant is removed so that the secondary gas refrigerant becomes a clean refrigerant. And, the clean secondary refrigerant flows into the above-described one of the conveying heat exchangers (7A, 7B). The secondary refrigerant repeats such an operation.

The secondary refrigerant seen through the sight glass (32) has a high viscosity when it includes much lubricating oil. However, when the amount of lubricating oil included in the secondary refrigerant is reduced by the repetitive cleaning operation, the viscosity of the secondary refrigerant decreases. Therefore, the completion of the cleaning operation is determined depending upon results of monitoring of the viscosity. When the cleaning operation is completed, the second step is complete.

After the completion of the cleaning operation, the upper and lower connecting passages (11, 12) are detached from the preinstalled refrigerant pipes (2A, 2B), thereby completing the third step. Then, outdoor and indoor units to be newly installed are connected to the preinstalled refrigerant pipes (2A, 2B). At the time, a new refrigerant different from the secondary refrigerant used for the cleaning operation may be charged into a new refrigerant circuit or the above secondary refrigerant may be used for the new refrigerant circuit.

Figure 2:
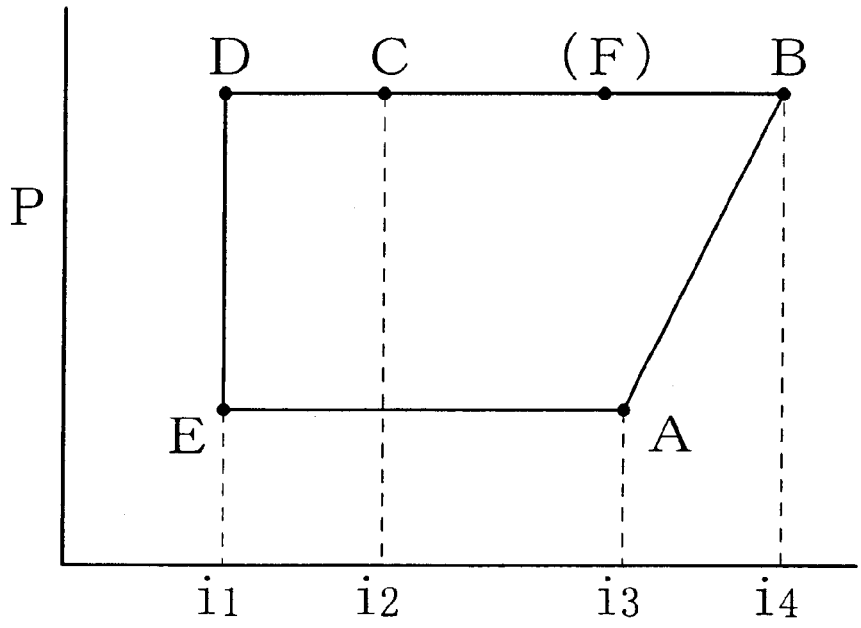
FIG. 2 is a plot showing heat balance in a refrigerating circuit of the Embodiment 1.

The heat balance in the refrigerating circuit (4R) for cleaning during the above-mentioned cleaning operation is as shown in FIG. 2. First, the primary refrigerant is increased in pressure from the point A to B by the compressor (41), and then thermally changes from the point B to C by heat radiation in the separating heat exchange coil (52) to give an amount of heat (=i4−i2) to the secondary refrigerant. Thereafter, the primary refrigerant thermally changes from the point C to D in one of the conveying heat exchangers (7A, 7B) to give an amount of heat (=i2−i1) to the secondary refrigerant. Further, the primary refrigerant thermally changes from the point E to A in the other conveying heat exchanger (.A, 7B) to take an amount of heat (=i3−i1) from the secondary refrigerant. It is to be noted that in FIG. 2, i4−i3=i2−i1 and i4−i2=i3−i1 are established and each have a thermally balanced relationship.

The primary refrigerant flowing through the separating heat exchange coil (52) may be changed in sensible heat only.

<Effects of Embodiment 1>

According to the present embodiment described so far, since the refrigerant pipes (2A, 2B) in the preinstalled refrigerant circuit can be cleaned, the preinstalled refrigerant pipes (2A, 2B) can be cleaned with reliability. Accordingly, the preinstalled refrigerant pipes (2A, 2B) can be used for a newly installed air conditioner while being left in place. As a result, the installation of an air conditioner can be simplified and reduced in cost.

Particularly, when an HFC refrigerant is used for a newly installed air conditioner, production of foreign substance can securely be prevented. This obviates the clogging of a capillary tube or the like, thereby ensuring the reliability of the air conditioner.

Furthermore, since the preinstalled refrigerant pipes (2A, 2B) can be used while being left in place, it is not necessary to strip part of walls and ceilings of the building in installing a new air conditioner. This allows a prompt installation of the new air conditioner and ensures the reliability thereof.

In addition, since the preinstalled refrigerant pipes (2A, 2B) are reused, this realizes recycling of such an existent resource.

Since the secondary refrigerant is conveyed in such a manner that the two conveying heat exchangers (7A, 7B) in the refrigerating circuit (4R) for cleaning alternately carry out repetitive cooling and pressurizing operations, respectively, this provides a high-reliability conveyance of refrigerant.

Further, since the refrigerating circuit (4R) for cleaning is formed of a single refrigerating circuit and the refrigerant is conveyed by means of a system using a secondary refrigerant, this provides a high-reliability conveyance of refrigerant with low power.

Furthermore, since the separator (50) heats the secondary refrigerant at the separating heat exchange coil (52) and captures foreign substance at the filter (53), foreign substance such as lubricating oil can securely be removed.

Moreover, since the direction of refrigerant circulation in the conveying passage section (4A) of the refrigerating circuit (4R) for cleaning is changed depending upon the discharge pressure of the compressor (41) or other factors, circulation of the cleaning refrigerant can be made with reliability.

<Embodiment 2>

Figure 3:
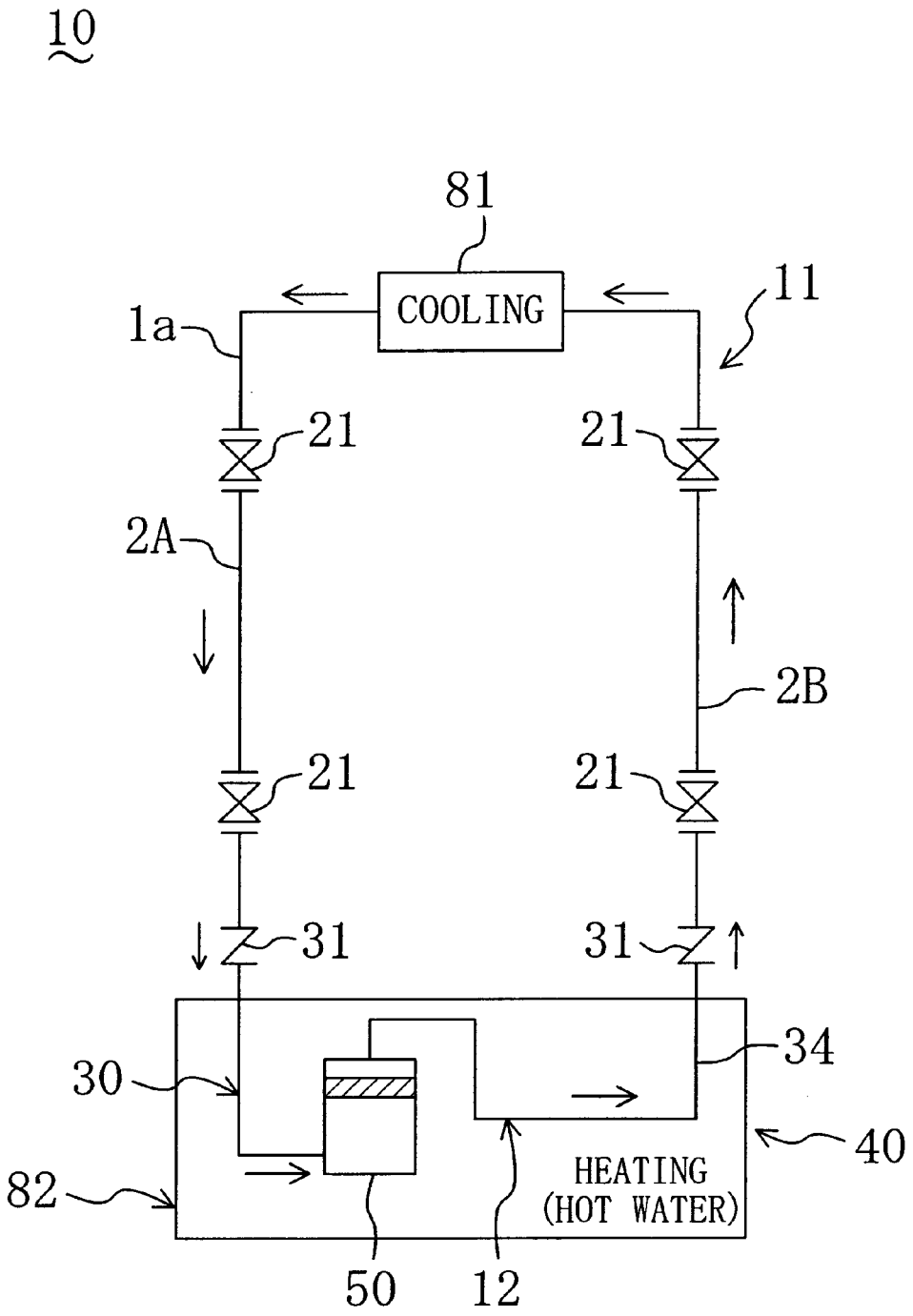
FIG. 3 is a refrigerant circuit diagram showing Embodiment 2 of the present invention.

FIG. 3 shows Embodiment 2 of the present invention, wherein the upper connecting passage (11) is provided with a cooling means (81) while the lower connecting passage (12) is provided with a pressurizing means (82).

The coolingmeans (81) is for cooling a cleaning refrigerant charged into the closed circuit (13) to depressurize it, and is supplied with, for example, cooling water or the like.

The pressurizing means (82) is composed of a heating tank (83) in which hot water or the like is stored, and is designed to pressurize the cleaning refrigerant, charged into the closed circuit (13), through the application of heat thereby giving a running force to the cleaning refrigerant kept in the liquid phase. Further, a separator (50) is provided in a connecting pipe (34) placed inside of the heating tank (83), and is designed to remove foreign substance such as lubricating oil from the refrigerant circulating in the closed circuit (13).

It is to be noted that the separator (50) is not for turning the refrigerant into the gas phase as in Embodiment 1 but is designed to remove foreign substance through the flow of refrigerant in the liquid phase.

Accordingly, the cleaning refrigerant charged into the closed circuit (13) is heated by the pressurizing means (82) to increase its pressure thereby flowing through one of the preinstalled refrigerant pipes (2A or 2B). Since the cooling means (81) cools the refrigerant in the closed circuit (13) to decrease the pressure thereof, it sucks the refrigerant flowing through the preinstalled refrigerant pipe (2A or 2B) from the pressurizing means (82). On the other hand, the refrigerant flows out of the cooling means (81) by gravity-drop, flows through the other preinstalled refrigerant pipe (2A or 2B)and then returns to the lower connecting passage (12). Then, foreign substance is removed from the refrigerant by the separator (50) in the lower connecting passage (12). Through the repetition of such an operation on the cleaning refrigerant, the preinstalled refrigerant pipes (2A, 2B) are cleaned. Thus, since the conveying means (40) is composed of the cooling means (81) and the pressurizing means (82), the cleaning refrigerant can be circulated with small conveying power. Other components, operations and effects are the same as those in Embodiment 1.

<Embodiment 3>

Figure 4:
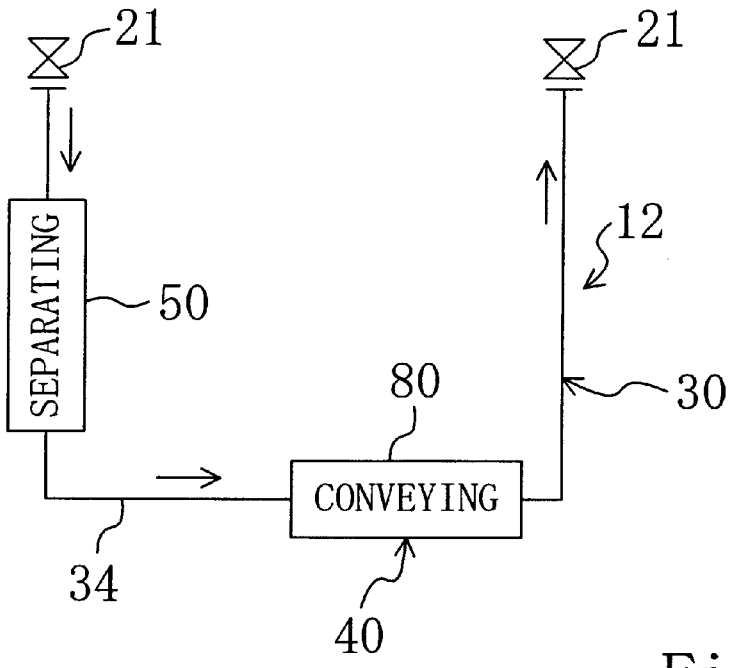
FIG. 4 is a refrigerant circuit diagram showing essential parts of Embodiment 3 of the present invention.

FIG. 4 shows Embodiment 3 of the present invention, wherein the lower connecting passage (12) is provided with a separator (50) and a conveying pump (80). Specifically, the separator (50) is designed, like Embodiment 2, to remove foreign substance through the flow of refrigerant in the liquid phase. The conveying pump (80) constitutes a conveying means (40) for conveying the refrigerant kept in the liquid phase through the closed circuit (13).

Accordingly, in Embodiment 3, the conveying pump (80) allows the refrigerant to circulate in the closed circuit (13) while being kept in the liquid phase. Concurrently, the refrigerant captures foreign substance from the preinstalled refrigerant pipes (2A, 2B) on its way of circulation and the separator (50) removes the foreign substance from the refrigerant in the liquid phase. In this manner, the preinstalled refrigerant pipes (2A, 2B) are cleaned. Thus, since the conveying means (40) is composed of the conveying pump (80), the cleaning refrigerant can be circulated with a simple structure. Other structures, operations and effects are the same as those in Embodiment 1.

<Embodiment 4>

Figure 5:
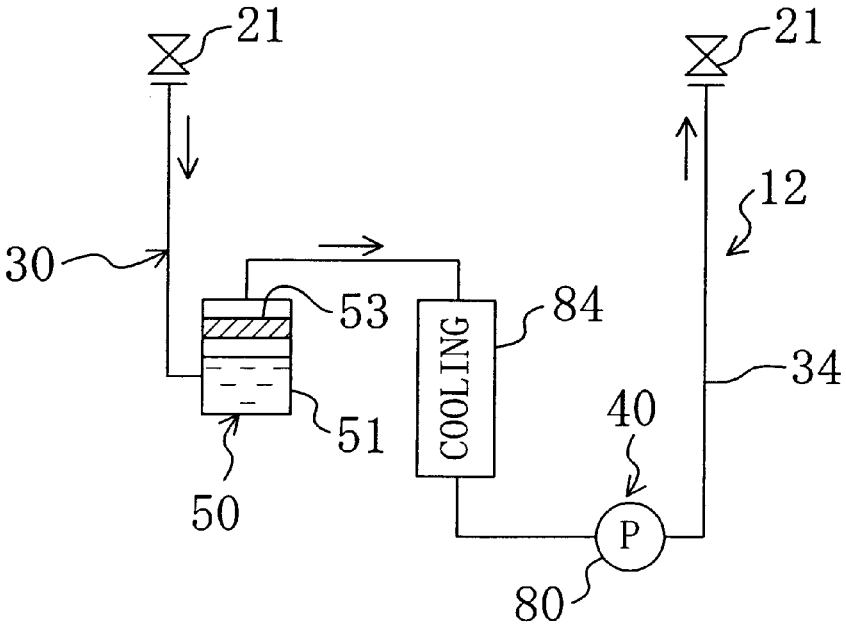
FIG. 5 is a refrigerant circuit diagram showing essential parts of Embodiment 4 of the present invention.

FIG. 5 shows Embodiment 4 of the present invention, wherein the lower connecting passage (12) is provided with a separator (50), a cooler (84) and a conveying pump (80). Specifically, the separator (50) is designed, like Embodiment 1, to heat the refrigerant in the liquid phase at the heating part (not shown) thereby turning it into the gas phase and to remove foreign substance from the refrigerant in the gas phase at a filter (53) thereof.

The cooler (84) constitutes a cooling means for cooling the refrigerant in the gas phase to condense it into the liquid phase, and the conveying pump (80) is for conveying the refrigerant, having been condensed in the cooler (84), with the refrigerant kept in the liquid phase.

Thus, according to Embodiment 4, the refrigerant in the liquid phase flows from one preinstalled refrigerant pipe (2A) to the other preinstalled refrigerant pipe (2B) through the upper connecting passage (11) by means of the conveying pump (80). The refrigerant captures foreign substance from the preinstalled refrigerant pipes (2A, 2B) on its way of flow, and the separator (50) causes the refrigerant to change the phase from liquid to gas thereby removing the foreign substance from the refrigerant. Thereafter, the cooler (84) causes the refrigerant to change the phase from gas to liquid again and to be sucked into the conveying pump (80). Such a circulation of refrigerant allows the preinstalled refrigerant pipes (2A, 2B) to be cleaned. Other structures, operations and effects are the same as those in Embodiment 1.

<Embodiment 5>

Figure 6:
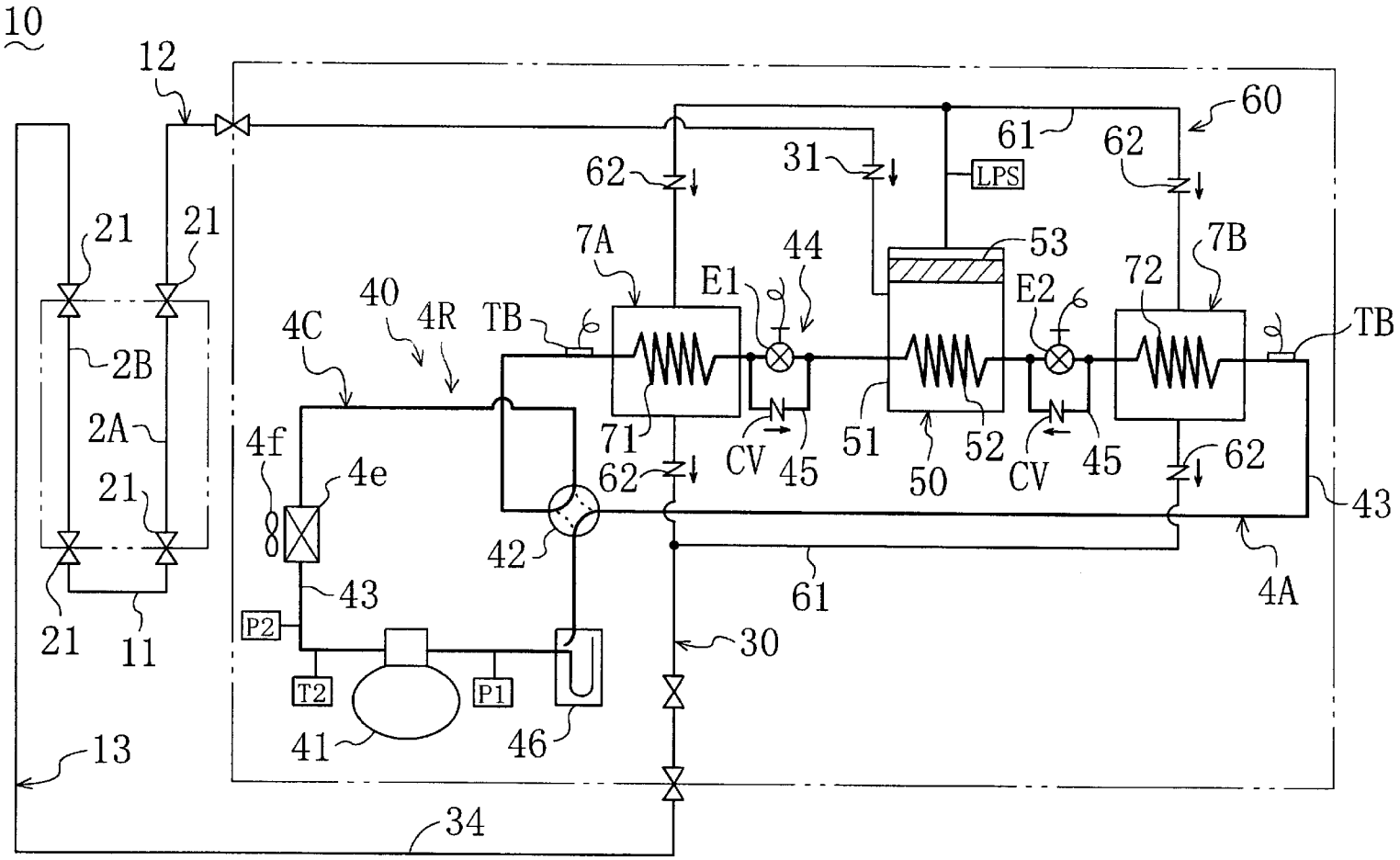
FIG. 6 is a refrigerant circuit diagram showing essential parts of Embodiment 5 of the present invention.
Figure 7:
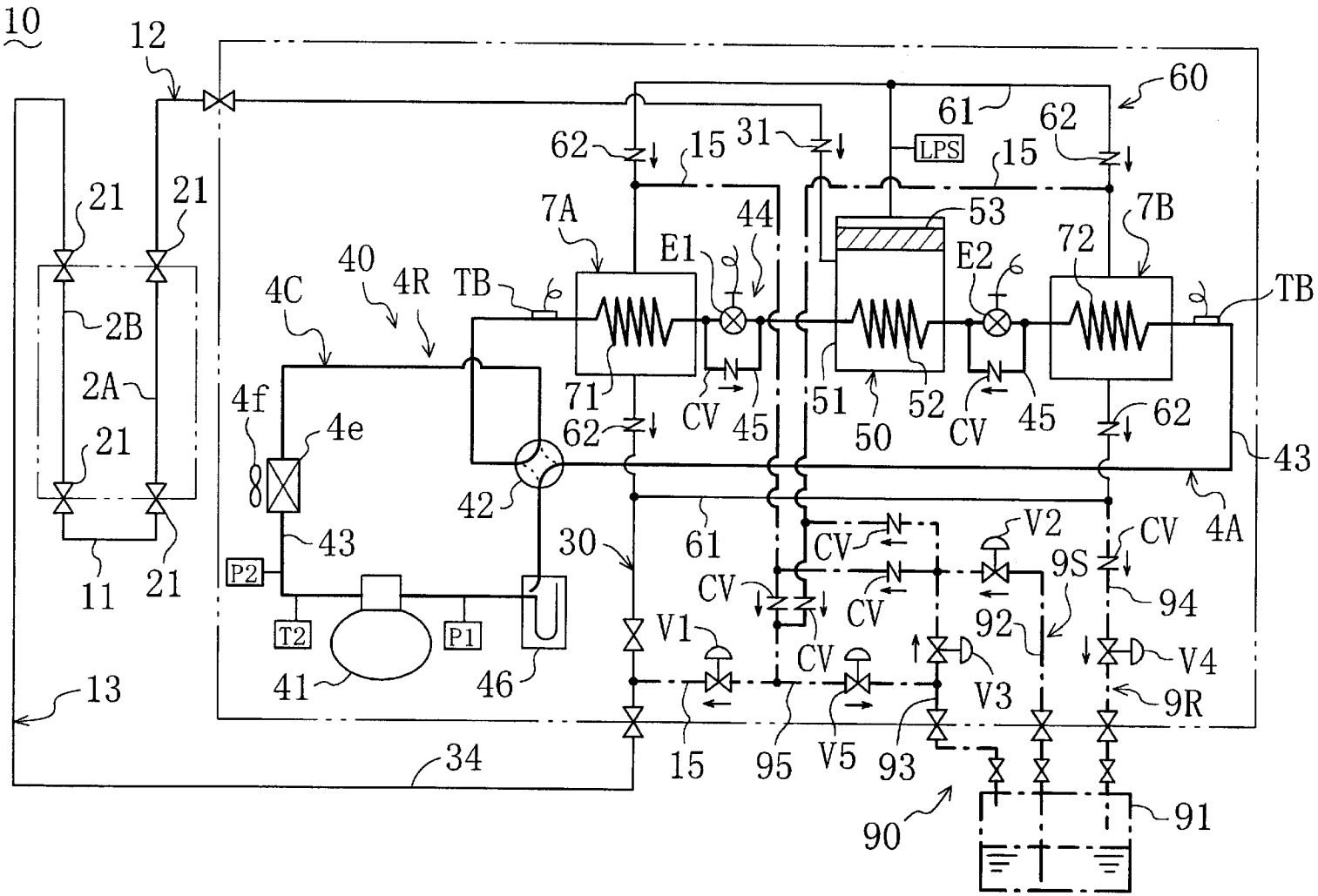
FIG. 7 is a refrigerant circuit diagram showing all parts of Embodiment 5 of the present invention.

FIGS. 6 and 7 show Embodiment 5 of the present invention, wherein the separating heat exchange coil (52) is interposed between the first and second conveying heat exchange coils (71, 72) in the refrigerating circuit (4R) for cleaning.

Specifically, the refrigerating circuit (4R) for cleaning constitutes a conveying means (40) in the form of a single independent refrigerating circuit consisting of a conveying passage section (4A) and a compression passage section (4C). The conveying passage section (4A) is connected to the compression passage section (4C) via a four-way selector valve (42) such that its direction of refrigerant flow with respect to the compression passage section (4C) can be reversed by the four-way selector valve (42).

The conveying passage section (4A) is constructed so that the first conveying heat exchange coil (71), a temperature-sensitive first expansion valve (E1), the separating heat exchange coil (52), a temperature-sensitive second expansion valve (E2) and the second conveying heat exchange coil (72) are connected in series. In addition, in the conveying passage section (4A), two bypass passages (45) each having a one-way valve (CV) are connected in parallel with the first and second expansion valves (E1, E2), respectively. Temperature sensing bulbs (TB) of the first and second expansion valves (E1, E2) are provided on the respective downstream sides of the first and second conveying heat exchange coils (71, 72). The first and second expansion valves (E1, E2) constitute a throttling mechanism (44).

The compression passage section (4C) is configured so that an air-cooled condenser (4*e*) and an accumulator (46) are provided on the discharge and suction sides of the compressor (41), respectively. The air-cooled condenser (4*e*) is for suppressing a pressure rise of the high-pressure refrigerant on the discharge side of the compressor (41), and is designed to drive an air-cooling fan (4*f*) when the pressure of the high-pressure refrigerant on the discharge side of the compressor (41) becomes equal to or above a predetermined value, because the pressure of the high-pressure refrigerant on the discharge side of the compressor (41) is increased when the amount of condensation of the primary refrigerant is reduced. The refrigerant, having been discharged from the compressor (41), is condensed in the air-cooled condenser (4*e*) and concurrently condensed in one conveying heat exchange coil (71 or 72), then heats the secondary refrigerant in the separating heat exchange coil (52) and is evaporated in the other conveying heat exchange coil (71 or 72).

In the compression passage section (4C), a low-pressure sensor (P1) is provided on the suction side of the compressor (41), while a high-pressure sensor (P2) and a temperature sensor (T2) are provided on the discharge side of the compressor (41). On the other hand, in a connecting pipe (34) of a cleaning interconnection passage (30), a low-pressure cut-out pressure switch (LPS) is provided on the downstream side of the separator (50). When the low pressure on the suction side of the compressor (41), detected by the low-pressure sensor (P1), becomes equal to or below a predetermined value, the four-way selector valve (42) is changed in its direction of flow so that the direction of refrigerant flow in the conveying passage section (4A) is changed. More specifically, when one conveying heat exchanger (7A or 7B) is filled with the secondary refrigerant in the liquid phase, the amount of heat exchange of the primary refrigerant is decreased so that the suction pressure of the compressor (41) is reduced. Therefore, the four-way selector valve (42) is changed in its direction of flow.

Further, the closed circuit (13) is designed such that the secondary refrigerant flows from the lower connecting passage (12) to the preinstalled gas-refrigerant pipe (2B) and circulates to the preinstalled liquid-refrigerant pipe (2A) through the upper connecting passage (11).

As shown in FIG. 7, the cleaning interconnection passage (30) is provided with a hot gas passage (15) and an auxiliary refrigerant passage (90) for charge and recovery of the secondary refrigerant.

The hot gas passage (15) is for supplying the secondary refrigerant of high temperature and high pressure to the preinstalled refrigerant pipes (2A, 2B) after the completion of the cleaning operation and for recovering the residual liquid secondary refrigerant in the preinstalled refrigerant pipes (2A, 2B) by evaporation. The hot gas passage (15) is branched into two parts on its influent side. Two influent ends of the hot gas passage (15) are connected to part of parallel passages (61, 61) located on the influent side of the conveying heat exchangers (7A, 7B), respectively, while the effluent end thereof is connected to part of the connecting pipe (34) located on the effluent side of the conveying heat exchangers (7A, 7B). In addition, one-way valves (CV) are provided on both the influent sides of the branch point of the hot gas passage (15), respectively, and a first shut-off valve (V1) is provided at the confluent part on the effluent side thereof.

The auxiliary refrigerant passage (90) includes a refrigerant bomb (91) and four auxiliary passages (92–95). The first auxiliary passage (92) is formed so that an effluent-side portion thereof is branched into two parts from an influent-side main portion thereof. The influent end of the first auxiliary passage (92) is brought into fluid communication with the refrigerant bomb (91), while the two effluent ends thereof are connected to the branched parts of the hot gas passage (15) downstream of the one-way valves (CV), respectively. In addition, the influent-side main portion of the first auxiliary passage (92) is provided with a second shut-off valve (V2), while the effluent-side branched parts thereof are provided with one-way valves (CV), respectively.

The second auxiliary passage (93) is communicated at one end thereof with the refrigerant bomb (91), is connected at the other end to part of the main portion of the first auxiliary passage (92) located downstream from the second shut-off valve (V2), and is provided with a third shut-off valve (V3). Thus, the first and second auxiliary passages (92, 93) and part of the branched parts of the hot gas passage (15) form a charging passage (9S) for charging the secondary refrigerant into the closed circuit (13).

The third auxiliary passage (94) is communicated at one end thereof with the refrigerant bomb (91), is connected at the other end to part of the connecting pipe (34) located downstream from the second conveying heat exchanger (7B), and is provided with a fourth shut-off valve (V4). The fourth auxiliary passage (95) is connected at one end thereof to part of the confluent part of the hot gas passage (15) located upstream from the first shut-off valve (V1), is connected at the other end to part of the main portion of the first auxiliary passage (92) located upstream from the second shut-off valve (V2), and is provided with a fifth shut-off valve (V5). Thus, the third and fourth auxiliary passages (94, 95) form a recovery passage (9R) for recovering the secondary refrigerant to the refrigerant bomb (91). Other structures are the same as those in Embodiment 1.

<Cleaning for Preinstalled Refrigerant Pipes (2A, 2B)>

Next, a cleaning operation of the above-described pipe cleaning apparatus for the preinstalled refrigerant pipes (2A, 2B) will be described together with a pipe cleaning method. It is to be noted that the basic part of the cleaning operation is the same as in Embodiment 1.

First, in the first step, the two preinstalled refrigerant pipes (2A, 2B) are connected to the upper connecting passage (11) and the cleaning interconnection passage (30) of the lower connecting passage (12) thereby forming a closed circuit (13) Then, while the first, fourth and fifth shut-off valves (V1, V4, V5) shown in FIG. 7 are kept closed, the second and third shut-off valves (V2, V3) are opened. This opening of these valves allows the secondary refrigerants, one in the liquid phase and the other in the gas phase, to pass from the refrigerant bomb (91) into the first and third auxiliary passages (92, 94), respectively, and then flow through the hot gas passage (15) and into the closed circuit (13). As a result, the secondary refrigerant, which serves as a cleaning refrigerant, is charged into the closed circuit (13).

Subsequently, the operation proceeds to the second step, in which the refrigerating circuit (4R) for cleaning in the lower connecting passage (12) is driven with the first through fifth shut-off valves (V1–V5) closed. In other words, the compressor (41) is driven to circulate the primary refrigerant. In the refrigerating circuit (4R) for cleaning, the primary refrigerant of high temperature and high pressure, having been discharged from the compressor (41), flows into one of the conveying heat exchange coils (71 or 72) through the air-cooled condenser (4*e*) and the four-way selector valve (42).

It is now proposed to begin the description with a state that the cleaning secondary refrigerant in the liquid phase is stored in the first conveying heat exchanger (7A) located on the right in FIG. 7 and the cleaning secondary refrigerant in the gas phase is stored in the second conveying heat exchanger (7B) located on the left in FIG. 7.

In this state, the four-way selector valve (42) is changed into the position shown in the solid lines of FIG. 1 so that the primary refrigerant of high temperature flows into the conveying heat exchange coil (71) of the first conveying heat exchanger (7A). As a result, the primary refrigerant is partly condensed therein to heat the secondary refrigerant in the liquid phase and increase its pressure. Because of this pressure rise, the secondary refrigerant obtains a running force while being kept in the liquid phase to flow out of the first conveying heat exchanger (7A) into the preinstalled refrigerant pipes (2A, 2B). In this case, the secondary refrigerant first flows through the preinstalled gas-refrigerant pipe (2B) of larger diameter and then flows into the preinstalled liquid-refrigerant pipe (2A) of smaller diameter through the upper connecting passage (11).

Further, the primary refrigerant, having passed through the first conveying heat exchanger (7A), flows into the separating heat exchange coil (52) of the separator (50) through the bypass passage (45) to evaporate the secondary refrigerant in the liquid phase stored in the tank (51) of the separator (50). Thereafter, the condensed primary refrigerant is depressurized by the second expansion valve (E2) and flows into the conveying heat exchange coil (72) of the second conveying heat exchanger (7B). In this conveying heat exchange coil (72), the primary refrigerant is evaporated to cool the cleaning secondary refrigerant in the gas phase and change it into the liquid phase. As a result of this phase change, the secondary refrigerant is reduced in pressure so that the secondary refrigerant in the liquid phase is stored in the second conveying heat exchanger (7B) while the secondary refrigerant in the gas phase is sucked from the separator (50). Then, the primary refrigerant evaporated in the second conveying heat exchanger (7B) return to the compressor (41) via the four-way selector valve (42). The primary refrigerant repeats such an operation.

Thereafter, when the second conveying heat exchanger (7B) is filled with the secondary refrigerant in the liquid phase, the four-way selector vale (42) is changed in its direction of flow. Specifically, when the amount of heat exchange of the primary refrigerant in the second conveying heat exchanger (7B) is decreased, the amount of throttling is increased because of control of the superheating degree through the second expansion valve (E2). Therefore, the low pressure on the suction side of the compressor (41) is decreased. When this low pressure detected by the low-pressure sensor (P1) becomes equal to or below a predetermined value, the four-way selector valve (42) is changed in its direction of flow.

The change in the direction of flow of the four-way selector valve (42) causes the primary refrigerant, having been discharged from the compressor (41), to flow into the second conveying heat exchanger (7B) to deliver the secondary refrigerant to the preinstalled refrigerant pipes (2A, 2B). Further, the primary refrigerant passes through the separating heat exchange coil (52) and is then evaporated in the first conveying heat exchanger (7A) to cool the secondary refrigerant and store it in the first conveying heat exchanger (7A). The primary refrigerant repeats such an operation to circulate the secondary refrigerant in the closed circuit (13).

This secondary refrigerant in the liquid phase flows through the preinstalled refrigerant pipes (2A, 2B) so that foreign substance such as lubricating oil, deposited on the inner surfaces of the preinstalled refrigerant pipes (2A, 2B), blends in the second refrigerant. The second refrigerant is evaporated in the separator (50) by heating from the separating heat exchange coil (52) so that foreign substance is separated and deposited in the tank (51). Further, when the secondary refrigerant passes through the filter (53), foreign substance such as lubricating oil blending in the secondary refrigerant is removed and the secondary refrigerant flows into the above-described one of the conveying heat exchangers (7A, 7B). The secondary refrigerant repeats such an operation.

In conveying the secondary refrigerant, when the amount of condensation of the primary refrigerant is reduced, the high pressure on the discharge side of the compressor (41) is increased. When this high pressure, detected by the high-pressure sensor (P2), becomes equal to or above a predetermined value, the air-cooling fan (4*f*) is driven. As a result, the primary refrigerant of high temperature and high pressure is partly condensed in the air-cooled condenser (4*e*) to turn into the refrigerant partly in the gas phase and partly in the liquid phase. This two-phase primary refrigerant flows into one of the conveying heat exchange coils (71 or 72) via the four-way selector valve (42). The condensation of the primary refrigerant in the air-cooled condenser (4*e*) causes a pressure drop in the high-pressure primary refrigerant.

In the third step, when the cleaning operation is completed, the first shut-off valve (V1) is closed so that the primary refrigerant of high temperature is supplied to the closed circuit (13). Specifically, in the conveying heat exchanger (7A or 7B) that increase the pressure of the secondary refrigerant by heating, the secondary refrigerant has the highest temperature and pressure immediately before the four-way selector valve (42) is changed in its direction of flow. This secondary refrigerant in the gas phase of high temperature and high pressure is delivered to the preinstalled refrigerant pipes (2A, 2B) through the hot gas passage (15). This secondary refrigerant of high temperature evaporates the secondary refrigerant in the liquid phase remaining in the preinstalled refrigerant pipes (2A, 2B).

Thereafter, while the first, second and third shut-off valves (V1, V2, V3) shown in FIG. 7 are kept closed, the fourth and fifth shut-off valves (V4, V5) are opened. This opening of these valves allows the secondary refrigerants, one in the liquid phase and the other in the gas phase, to pass through the third and fourth auxiliary passages (94, 95), respectively, and then flow through the first auxiliary passage (92) and into the refrigerant bomb (91) of low pressure. In this manner, the secondary refrigerant is recovered. Then, the upper and lower connecting passages (11, 12) are detached from the preinstalled refrigerant pipes (2A, 2B).

The heat balance in the refrigerating circuit (4R) for cleaning during the above-mentioned cleaning operation is as shown in FIG. 2. First, the primary refrigerant is increased in pressure from the point A to B by the compressor (41), and then thermally changes from the point B to F by heat radiation in the air-cooled condenser (4*e*). Then, the primary refrigerant thermally changes from the point F to C in one of the conveying heat exchangers (7A or 7B). Thereafter, the primary refrigerant thermally changes from the point C to D in the separating heat exchange coil (52). Further, the primary refrigerant thermally changes from the point E to A in the other conveying heat exchanger (7A or 7B). Other operations are the same as those in Embodiment 1.

<Effects of Embodiment 5>

According to the present embodiment described so far, since the primary refrigerant, part of which has been condensed in one of the conveying heat exchangers (7A or 7B), is further condensed by the separating heat exchange coil (52), a sufficient amount of heat for pressurizing the secondary refrigerant can be secured. This allows the secondary refrigerant to be circulated in the closed circuit (13) with reliability.

In particular, for the use of an HFC refrigerant as the secondary refrigerant, some HFC refrigerants have temperature gradients with respect to the isobaric line between the saturated liquid line and the saturated vapor line in the Mollier diagram. Therefore, if the condensation temperature of the primary refrigerant is constant, the pressure of the secondary refrigerant evaporating in the separator (50) becomes lower than that of the secondary refrigerant flowing out of the conveying heat exchanger (7A or 7B). As a result, the secondary refrigerant can be circulated in the closed circuit (13) with reliability.

Further, since the compressing passage section (4C) is provided with an air-cooled condenser (4*e*), condensation and heat radiation can be made on the primary refrigerant with reliability. This securely prevents an excessive rise in the pressure of the high-pressure refrigerant in the refrigerating circuit (4R) for cleaning.

Furthermore, since the secondary refrigerant is passed into the preinstalled liquid-refrigerant pipe (2A) of smaller diameter from the preinstalled gas-refrigerant pipe (2B) of larger diameter, the secondary refrigerant can be circulated without expanding halfway therebetween. Accordingly, the secondary refrigerant can be circulated while being kept in the liquid phase, thereby suppressing the decrease in the cleaning efficiency.

Moreover, since the hot gas passage (15) is provided, the residual secondary refrigerant in the preinstalled refrigerant pipes (2A, 2B) at the completion of cleaning can securely be evaporated and recovered.

In addition, since the auxiliary refrigerant passage (90) is provided, charge and recovery of the secondary refrigerant can be made with reliability. Other effects are the same as those in Embodiment 1.

<Embodiment 6>

Figure 8:
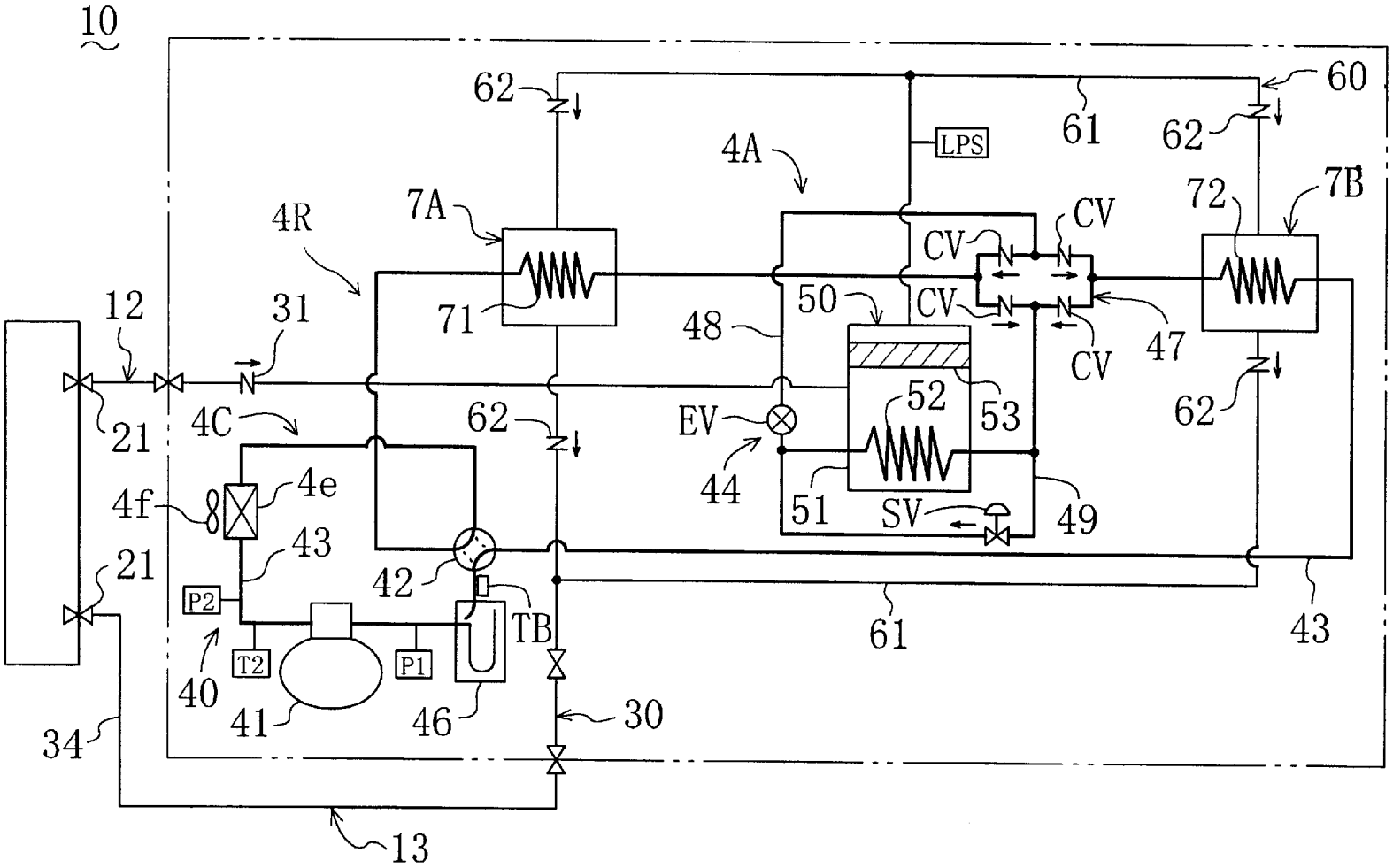
FIG. 8 is a refrigerant circuit diagram showing essential parts of Embodiment 6 of the present invention.
Figure 9:
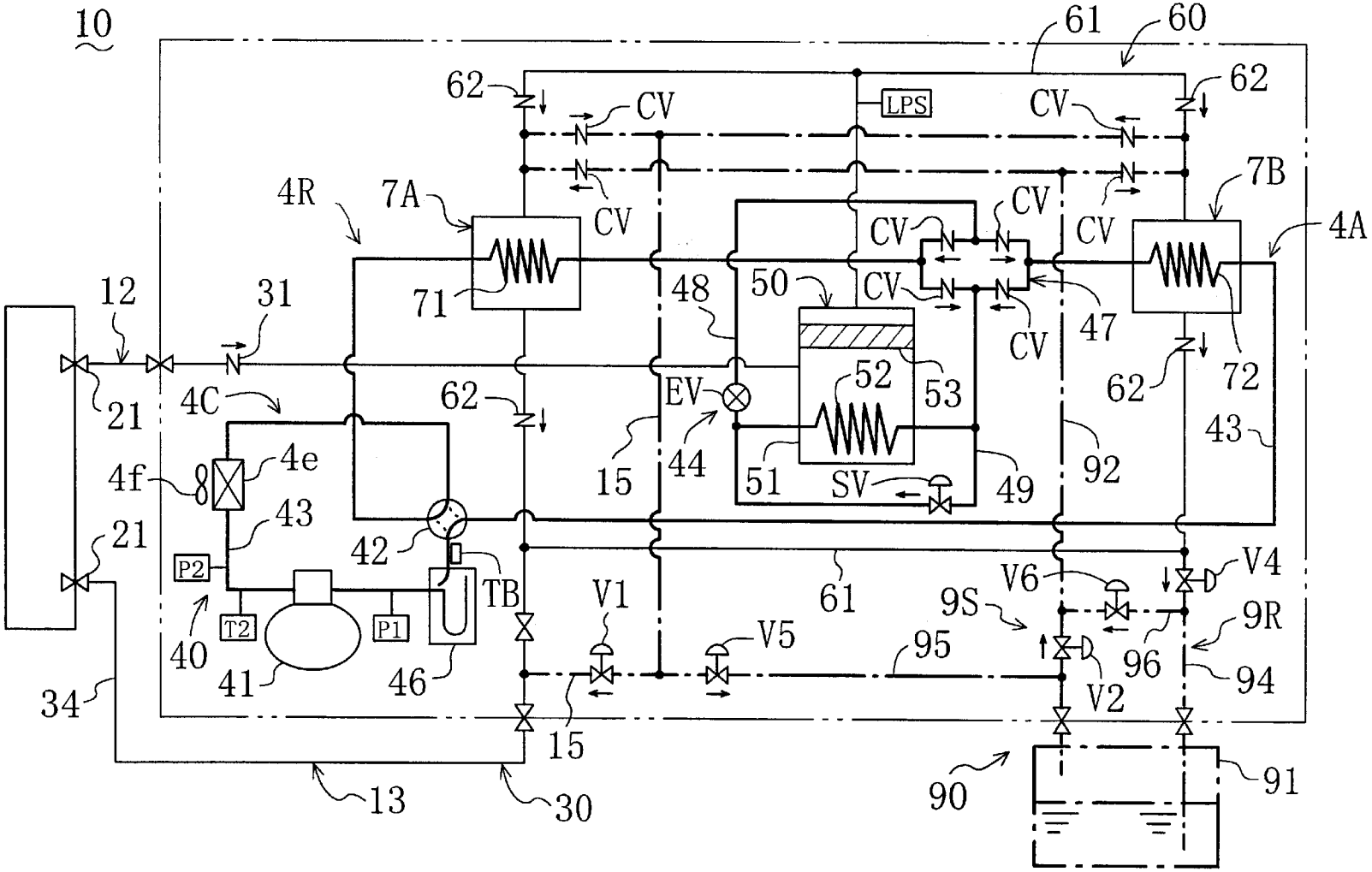
FIG. 9 is a refrigerant circuit diagram showing all parts of Embodiment 6 of the present invention.

FIGS. 8 and 9 show Embodiment 6 of the present invention, wherein a rectification circuit (47) and a single expansion valve (EV) are provided in the refrigerating circuit (4R) for cleaning, in place of the first and second expansion valves (E1, E2) provided in Embodiment 5.

More specifically, the conveying passage section (4A) of the refrigerating circuit (4R) for cleaning is provided with the rectification circuit (47) and a one-way passage (48). The rectification circuit (47) is formed into a bridge circuit including four one-way valves (CV). Two of four connecting points of the bridge circuit are connected to the one-way passage (48), and the other two connecting points are connected to the first and second conveying heat exchange coils (71, 72), respectively.

In the one-way passage (48), the separating heat exchange coil (52) and the expansion valve (EV) are connected in the order from upstream to downstream sides. The pressure sensing bulb (TB) for the expansion valve (EV) is attached to the influent side of the accumulator (46).

The one-way passage (48) is connected to a differential pressure control passage (49) including a shut-off valve (SV). The differential pressure control passage (49) is arranged in parallel with the separating heat exchange coil (52) such that the primary refrigerant can bypass the separating heat exchange coil (52). The shut-off valve (SV) is adapted, for example, to open or close at specific intervals to stop the condensation of the primary refrigerant in the separating heat exchange coil (52), i.e., the evaporation of the secondary refrigerant, at specific intervals thereby decreasing the pressure of the secondary refrigerant in the separator (50).

On the other hand, as shown in FIG. 9, the auxiliary refrigerant passage (90) has two ports connecting to the refrigerant bomb (91) unlike Embodiment 5. In addition, unlike Embodiment 5, the first auxiliary passage (92) is connected at two effluent ends thereof directly to portions of the parallel passages (61, 61) located on the influent sides of the conveying heat exchangers (7A, 7B), respectively. The fourth auxiliary passage (95) is connected between the hot gas passage (15) and the first auxiliary passage (92).

In addition, a fifth auxiliary passage (96) is provided in place of the second auxiliary passage (93) of Embodiment 5. The fifth auxiliary passage (96) is provided with a sixth shut-off valve (V6), is connected at one end thereof to part of the third auxiliary passage (94) located downstream from the fourth shut-off valve (V4), and is connected at the other end to part of the main portion of the first auxiliary passage (92) located downstream from the second shut-off valve (V2). Thus, the first auxiliary passage (92), part of the third auxiliary passage (94) and the fifth auxiliary passage (96) form a charging passage (9S) for charging the secondary refrigerant into the closed circuit (13). Further, the third and fourth auxiliary passages (94, 95) and part of the first auxiliary passage (92) form a recovery passage (9R) for recovering the secondary refrigerant to the refrigerant bomb (91). Other structures are the same as those in Embodiment 5.

<Cleaning for Preinstalled Refrigerant Pipes (2A, 2B)>

The cleaning operation of the above-described pipe cleaning apparatus for the preinstalled refrigerant pipes (2A, 2B) is similar to Embodiment 5. However, in charging the refrigerant in the first step, the second and sixth shut-off valves (V2, V6) are opened with the first, fourth and fifth shut-off valves (V1, V4, V5) closed. This opening of these valves allows the secondary refrigerants, one in the liquid phase and the other in the gas phase, to pass from the refrigerant bomb (91) into the first and fifth auxiliary passages (92, 96), respectively, and then flow into the closed circuit (13). As a result, the secondary refrigerant, which serves as a cleaning refrigerant, is charged into the closed circuit (13).

In the second step, the operation is the same as in Embodiment 5 with the exception that the primary refrigerant circulates through the rectification circuit (47) and the one-way passage(48). However, in this embodiment, the shut-off valve (SV) in the differential pressure control passage (49) is opened or closed, for example, at specific intervals. Accordingly, condensation of the primary refrigerant in the separating heat exchange coil (52), i.e., evaporation of the secondary refrigerant, is stopped at specific intervals. As a result, the temperature of the secondary refrigerant in the separator (50) is decreased so that the pressure of the secondary refrigerant is reduced. Therefore, the pressure of the secondary refrigerant in the separator (50) becomes lower than that of the secondary refrigerant in one of the conveying heat exchangers (7A or 7B) that delivers the primary refrigerant by pressurization. Consequently, a differential pressure between the one conveying heat exchanger (7A or 7B) and the separator (50) is ensured, which circulates the secondary refrigerant with reliability.

In recovering the refrigerant in the third step, the fourth and fifth shut-off valves (V4, V5) are opened with the first, second and sixth shut-off valves (V1, V2, V6) closed. This opening of these valves allows the secondary refrigerants, one in the liquid phase and the other in the gas phase, to pass through the third and fourth auxiliary passages (94, 95), respectively, and then flow into the low-pressure refrigerant bomb (91) through the first auxiliary passage (92). In this manner, the secondary refrigerant is recovered. Other operations are the same as those in Embodiment 5.

<Effects of Embodiment 6>

According to the present embodiment described so far, since the differential pressure control passage (49) is provided through which the primary refrigerant bypasses the separating heat exchange coil (52), the pressure of the secondary refrigerant in the separator (50) can be lowered than that of the secondary refrigerant in one of the conveying heat exchangers (7A or 7B) that delivers the primary refrigerant by pressurization. This ensures a differential pressure between the conveying heat exchanger (7A or 7B) and the separator (50) with reliability. As a result, the secondary refrigerant can securely be circulated. Other effects are the same as those in Embodiment 5.

<Other Embodiments>

In Embodiments 1 and 4 shown in FIGS. 1 and 5, respectively, the separator (50) has been constructed so that the tank (51) accommodates the separating heat exchange coil (52) and the filter (53). However, the filter (53) may not necessarily be provided. Specifically, for example, when foreign substance is lubricating oil, the liquid refrigerant is evaporated inside of the tank (51) so as to be concentrated with the lubricating oil thereby separating the lubricating oil. As a result, by simply heating the refrigerant by the separating heat exchange coil (52), foreign substance is separated.

In Embodiment 1 shown in FIG. 1, the separating heat exchange coil (52) and the two conveying heat exchangers (7A, 7B) have been provided in the single refrigerating circuit (4R) for cleaning. However, the separating heat exchange coil (52) and the two conveying heat exchangers (7A, 7B) may constitute individual refrigerating circuits. Further, the separating heat exchange coil (52) may be a heating part of an electric heater or the like.

In Embodiment 2 shown in FIG. 3, the cooling means (81) has been provided at the upper position, while the pressurizing means (82) has been provided at the lower position. However, the cooling means (81) may not necessarily be provided at the uppermost position and may be at some midpoint above the pressurizing means (82).

The present invention may be applied to abandon the cleaning refrigerant in which foreign substance such as lubricating oil is blended after the cleaning work. In this case, the separating means such as the separator (50) may not necessarily be provided.

In the above embodiments, the cleaning of the preinstalled refrigerant pipes (2A, 2B) has been described. It goes without saying that the present invention may be applied to clean newly installed refrigerant pipes (2A, 2B) as well as the preinstalled ones.

The secondary refrigerant to be charged into the closed circuit (13) of the present invention is not limited to a clean refrigerant and may be any refrigerant suitable for cleaning.

The two conveying heat exchangers (7A, 7B) in Embodiment 1 of FIG. 1 may be any heat exchangers for heat-exchanging the secondary refrigerant in the closed circuit (13) and the primary refrigerant in the refrigerating circuit (4R) for cleaning. Specifically, the conveying heat exchanger (7A, 7B) may include various kinds of heat exchangers such as a laminated heat exchanger (plate type heat exchanger), a flooded system heat exchanger and a double-pipe heat exchanger. In other words, the conveying heat exchanger may be any heat exchanger that drives off the secondary liquid refrigerant for cleaning to the refrigerant pipes (2A, 2B) through the application of heat.

The above embodiments are directed to the refrigerant circuit in which two preinstalled refrigerant pipes (2A, 2B) are provided. However, needless to say, the present invention may also be directed to a refrigerant circuit including three or more preinstalled refrigerant pipes (2A, 2B).

In the above embodiments, an HFC refrigerant has been applied as a cleaning refrigerant. However, an HC refrigerant or an FC refrigerant may be applied as an alternative cleaning refrigerant.

In addition, it goes without saying that the cleaning refrigerant of the present invention is not necessarily the same as newly charged into a new refrigerant circuit constituted by the cleaned refrigerant pipes (2A, 2B).

INDUSTRIAL APPLICABILITY

As described so far, the pipe cleaning method and the pipe cleaning apparatus for a refrigerating apparatus according to the present invention is useful in using preinstalled refrigerant pipes for a renewed air conditioner while being left in place, and particularly suitable for the use of an HFC refrigerant or the like in place of a conventional CFC or HCFC refrigerant.

What is claimed is:

1. A pipe cleaning method for a refrigerant apparatus in which refrigerant pipes (2A,2B) in a refrigerant circuit is cleaned, the method comprises:

a first step of forming a single closed circuit (13) by connecting a connecting passage (12) for cleaning to at least one end of each of the refrigerant pipes (2A,2B) and charging a refrigerant into the closed circuit (13);

a second step of cleaning the refrigerant pipes (2A,2B) by circulating the refrigerant in the closed circuit (13) so that the refrigerant in liquid phase flows through the refrigerant pipes (2A,2B) by means of conveying means (40) provided in the connecting passage (12) and separating a foreign substance from the refrigerant using separating means (50); and a third step of after the cleaning step, detaching the connecting passage (12) from the refrigerant pipes (2A,2B), wherein the second step includes: heating the refrigerant in liquid phase using the separating means (50) during passage of the refrigerant through the connecting passage (12) to change the phase of the refrigerant from liquid to gas thereby to separate the foreign substance from the refrigerant; subsequently cooing the refrigerant in gas phase to change the phase of the refrigerant from gas to liquid; and delivering the refrigerant in liquid phase to the refrigerant pipes (2A,2B) using the conveying means (40), and the conveying means (40) includes two conveying heat exchangers (7A,7B) each provided at some midpoint of the connecting passage (12) and connected in parallel with each other, the two conveying heat exchangers (7A,7B) alternating a cooling operation of cooling the refrigerant of which phase is changed to gas by the separating means (50) to change the phase of the refrigerant from gas to liquid, and a pressurizing operation of heating and pressurizing the refrigerant in liquid phase to deliver the refrigerant in liquid phase to the refrigerant pipes (2A,2B).

2. The pipe cleaning method for a refrigerating apparatus of claim 1, characterized in that the second step includes circulating the refrigerant from the conveying means (40) to the liquid-refrigerant pipe (2A) through the gas-refrigerant pipe (2B) in the refrigerant circuit.

3. The pipe cleaning method for a refrigerating apparatus of claim 1, characterized in that the first step includes charging the refrigerant into the closed circuit (13) from a refrigerant bomb (91) through a charging passage (9S), and the third step includes recovering the refrigerant to the refrigerant bomb (91) from the closed circuit (13) through a recovery passage (9R) and then detaching the connecting passage (12) from the refrigerant pipes (2A, 2B).

4. The pipe cleaning method for a refrigerating apparatus of claim 1, characterized in that the refrigerant for cleaning charged into the closed circuit (13) is the same as charged into a new refrigerant circuit constituted by the cleaned refrigerant pipes (2A, 2B).

5. The pipe cleaning method for a refrigerating apparatus of claim 1, characterized in that the refrigerant charged into the closed circuit (13) is one of an HFC refrigerant, an HC refrigerant and an FC refrigerant.

6. A pipe cleaning apparatus for a refrigerant apparatus in which refrigerant pipes (2A,2B) in a refrigerant circuit are cleaned, comprising:

a connecting passage (12) for cleaning which is connected to at least one end of each of the refrigerant pipes (2A,2B) in the refrigerant circuit to constitute a closed circuit (13) together with the refrigerant pipes (2A,2B); and conveying means (40), provided in the connecting passage (12), for applying a running force to the refrigerant charged into the closed circuit (13) so that the refrigerant circulates in the closed circuit (13) and the liquid refrigerant cleans the refrigerant pipes (2A,2B) by the flow thereof through the refrigerant pipes (2A,2B), the conveying means (40) including two conveying heat exchangers (7A,7B) each provided at some midpoint of the connecting passage (12) and connected in parallel with each other, and the two conveying heat exchangers (7A,7B) alternating a cooling operation of cooling the refrigerant of which phase is changed to gas by the separating means (50) to change the phase of the refrigerant from gas to liquid, and a pressurizing operation of heating and pressurizing the refrigerant in liquid phase, wherein the refrigerant is recovered by the cooling operation and the refrigerant is delivered to the refrigerant pipes (2A,2B) by the pressurizing operation.

7. The pipe cleaning apparatus for a refrigerating apparatus of claim 6, characterized in that the connecting passage (12) is provided with separating means (50) for separating foreign substance from the refrigerant circulating in the closed circuit (13).

8. The pipe cleaning apparatus for a refrigerating apparatus of claim 7, characterized in that the separating means (50) separates foreign substance from the refrigerant by capturing the foreign substance during the passage of the refrigerant in the liquid phase therethrough.

9. The pipe cleaning apparatus for a refrigerating apparatus of claim 7, characterized in that the separating means (50) includes: a tank (51) for storing the liquid refrigerant having circulated in the closed circuit (13); and a heating part (52), accommodated in the tank (51), for evaporating the liquid refrigerant in the tank (51) by heating to separate foreign substance therefrom.

10. The pipe cleaning apparatus for a refrigerating apparatus of claim 7, characterized in that the separating means (50) includes: a tank (51) for storing the liquid refrigerant having circulated in the closed circuit (13); a heating part (52), accommodated in the tank (51), for evaporating the liquid refrigerant in the tank (51) by heating; and a capturing part (53) for allowing the flow of the gas refrigerant and capturing foreign substance in the gas refrigerant.

11. The pipe cleaning apparatus for a refrigerating apparatus of claim 6, characterized in that the heating part (52) of the separating means (50) is formed of a separating heat exchange coil (52), the separating heat exchange coil (52) is connected to the two conveying heat exchangers (7A, 7B) of the conveying means (40) to constitute a single refrigerating circuit (4R) for cleaning where a primary refrigerant circulates separately from the closed circuit (13) so that the primary refrigerant heat-exchanges with a secondary refrigerant circulating in the closed circuit (13), and the refrigerating circuit (4R) for cleaning includes: a conveying passage section (4A) in which conveying refrigerant passages (71, 72) for passing the primary refrigerant therethrough are formed in the conveying heat exchangers (7A, 7B), respectively, and are connected in series to each other through a throttling mechanism (44); a separating passage section (4B) which is communicated with the conveying passage section (4A) and in which the separating heat exchange coil (52) is connecting in series to the discharge side of the compressor (41); and selecting means (42) for changing the direction of refrigerant flow in the conveying passage section (4A) with respect to the separating passage section (4B) so that repetitive condensation and evaporation of the primary refrigerant are alternately provided by the conveying heat exchangers (7A, 7B), respectively.

12. The pipe cleaning apparatus for a refrigerating apparatus of claim 6, characterized in that the refrigerating circuit (4R) for cleaning changes the direction of refrigerant flow in the conveying passage section (4A) when the discharge pressure of the compressor (41) becomes equal to or above a predetermined value, or when the discharge temperature of the compressor (41) becomes equal to or below a predetermined value, or when the internal pressure of the separating means (50) becomes equal to or above a predetermined value.

13. The pipe cleaning apparatus for a refrigerating apparatus of claim 6, characterized in that the heating part (52) of the separating means (50) is formed of a separating heat exchange coil (52), the separating heat exchange coil (52) is connected to the two conveying heat exchangers (7A, 7B) of the conveying means (40) to constitute a single refrigerating circuit (4R) for cleaning where a primary refrigerant circulates separately from the closed circuit (13) so that the primary refrigerant heat-exchanges with a secondary refrigerant circulating in the closed circuit (13), the refrigerating circuit (4R) for cleaning includes: a conveying passage section (4A) including conveying refrigerant passages (71, 72), formed in the conveying heat exchangers (7A, 7B), respectively, for passing the primary refrigerant therethrough, the separating heat exchange coil (52) and a throttling mechanism (44); a compression passage section (4C) including the compressor (41) and communicated with the conveying passage section (4A); and selecting means (42) for changing the direction of refrigerant flow in the conveying passage section (4A) with respect to the compression passage section (4C) so that repetitive condensation and evaporation of the primary refrigerant are alternately provided by the conveying heat exchangers (7A, 7B), respectively, and the conveying passage section (4A) is configured so that the primary refrigerant is condensed by one of the conveying heat exchangers (7A or 7B), flows through the separating heat exchange coil (52), is reduced in pressure by the throttling mechanism (44) and is evaporated by the other conveying heat exchanger (7A or 7B).

14. The pipe cleaning apparatus for a refrigerating apparatus of claim 13, characterized in that the compression passage section (4C) has an air-cooled condenser (4*e*), provided on the discharge side of the compressor (41), for condensing the primary refrigerant discharged from the compressor (41).

15. The pipe cleaning apparatus for a refrigerating apparatus of claim 14, characterized in that the air-cooled condenser (4*e*) drives an air-cooling fan (4*f*) when the discharge pressure of the compressor (41) becomes equal to or above a predetermined value.

16. The pipe cleaning apparatus for a refrigerating apparatus of claim 13, characterized in that the refrigerating circuit (4R) for cleaning is configured so that the selecting means (42) changes the direction of refrigerant flow in the conveying passage section (4A) when the suction pressure of the compressor (41) becomes equal to or below a predetermined value.

17. The pipe cleaning apparatus for a refrigerating apparatus of claim 13, characterized in that the refrigerating circuit (4R) for cleaning is provided with a differential pressure control passage (49) bypassing the separating heat exchange coil (52) and including a shut-off valve (SV).

18. The pipe cleaning apparatus for a refrigerating apparatus of claim 11 or 13, characterized in that the connecting passage (12) is provided with a charging passage (9S) for charging the secondary refrigerant into the closed circuit (13) from a refrigerant bomb (91) before cleaning is carried out, and a recovery passage (9R) for recovering the secondary refrigerant from the closed circuit (13) to the refrigerant bomb (91) after cleaning is carried out.

19. The pipe cleaning apparatus for a refrigerating apparatus of claim 11 or 13, characterized in that the connecting passage (12) is provided with a hot gas passage (15) for ducting the secondary refrigerant of high temperature and high pressure from the upstream side of the conveying heat exchangers (7A, 7B) when cleaning is completed to supply the ducted secondary refrigerant to the downstream side of the conveying heat exchangers (7A, 7B).

20. The pipe cleaning apparatus for a refrigerating apparatus of claim 6, characterized in that the connecting passage (12) is configured so that the refrigerant circulates from the conveying means (40) to the liquid-refrigerant pipe (2A) through the gas-refrigerant pipe (2B) in the refrigerant circuit.

21. The pipe cleaning apparatus for a refrigerating apparatus of claim 6, characterized in that the cleaning refrigerant charged into the closed circuit (13) is the same as charged into a new refrigerant circuit constituted by the cleaned refrigerant pipes (2A, 2B).

22. The pipe cleaning apparatus for a refrigerating apparatus of claim 6, characterized in that the refrigerant charged into the closed circuit (13) is an HFC refrigerant, an HC refrigerant or an FC refrigerant.

23. A pipe cleaning method for a refrigerant apparatus in which refrigerant pipes (2A,2B) in a refrigerant circuit is cleaned, the method comprises:

a first step of forming a single closed circuit (13) by connecting a connecting passage (12) for cleaning to at least one end of each of the refrigerant pipes (2A,2B) and charging a refrigerant into the closed circuit (13);

a second step of cleaning the refrigerant pipes (2A,2B) by circulating the refrigerant in the closed circuit (13) so that the refrigerant in liquid phase flows through the refrigerant pipes (2A,2B) using conveying means (40) provided in the connecting passage (12) and separating a foreign substance from the refrigerant using separating means (50); and a third step of after the cleaning step, detaching the connecting passage (12) from the refrigerant pipes (2A,2B), wherein the second step includes: a first separating operation of heating the refrigerant in liquid phase by the separating means (50) during passage of the refrigerant through the connecting passage (12) to change the phase of the refrigerant from liquid to gas thereby separating the foreign substance from the refrigerant; and a second separating operation of capturing the foreign substance from the refrigerant in gas phase; cooling the refrigerant in gas phase to change the phase of the refrigerant from gas to liquid; and delivering the refrigerant in liquid phase to the refrigerant pipes (2A,2B) using the conveying means (40), and the conveying means (40) includes two conveying heat exchangers (7A,7B) each provided at some midpoint of the connecting passage (12) and connected in parallel with each other, the two conveying heat exchangers (7A,7B) alternating a cooling operation of cooling the refrigerant of which phase is changed to gas by the separating means (50) to change the phase of the refrigerant from gas to liquid, and a pressurizing operation of heating and pressurizing the refrigerant in liquid phase to deliver the refrigerant in liquid phase to the refrigerant pipes (2A,2B).

24. The pipe cleaning method for a refrigerating apparatus of claim 23, characterized in that the second step includes circulating the refrigerant from the conveying means (40) to the liquid-refrigerant pipe (2A) through the gas-refrigerant pipe (2B) in the refrigerant circuit.

25. The pipe cleaning method for a refrigerating apparatus of claim 23, characterized in that the first step includes charging the refrigerant into the closed circuit (13) from a refrigerant bomb (91) through a charging passage (9S), and the third step includes recovering the refrigerant to the refrigerant bomb (91) from the closed circuit (13) through a recovery passage (9R) and then detaching the connecting passage (12) from the refrigerant pipes (2A, 2B).

26. The pipe cleaning method for a refrigerating apparatus of claim 23, characterized in that the refrigerant for cleaning charged into the closed circuit (13) is the same as charged into a new refrigerant circuit constituted by the cleaned refrigerant pipes (2A, 2B).

27. The pipe cleaning method for a refrigerating apparatus of claim 23, characterized in that the refrigerant charged into the closed circuit (13) is one of an HFC refrigerant, an HC refrigerant and an FC refrigerant.

* * * * *